US005881515A

United States Patent [19]

George

[11] Patent Number: 5,881,515

[45] Date of Patent: Mar. 16, 1999

[54] CONCATENATED STRUCTURES OF MODULAR MEMBERS

[76] Inventor: Mark D. George, 1251 SW. Collins, Topeka, Kans. 66604

[21] Appl. No.: 732,939

[22] Filed: Oct. 17, 1996

Related U.S. Application Data

[60] Provisional application No. 60/005,822 Oct. 23, 1995.

[51] Int. Cl.[6] ..... A63H 33/04; E04B 1/02

[52] U.S. Cl. ..... 52/233; 52/169.4; 52/585.1; 403/294; 403/400; 446/113; 446/122; 446/476

[58] Field of Search ..... 52/233, 585.1, 52/169.4, 745.13, 747.1, 448.1; 446/85, 113, 123, 476, 122; 403/292, 294, 396, 400

[56] References Cited

U.S. PATENT DOCUMENTS

| | | | |
|---|---|---|---|
| 2,365,397 | 12/1944 | Dickman . | |
| 2,669,060 | 2/1954 | Kalvig | 52/233 |
| 3,006,038 | 10/1961 | Sullivan . | |
| 3,036,407 | 5/1962 | Dixon . | |
| 4,521,203 | 6/1985 | Rothenberg, Jr. . | |
| 4,664,358 | 5/1987 | Clark . | |
| 4,688,362 | 8/1987 | Pederson et al. | 52/233 X |
| 4,834,585 | 5/1989 | Hasenwinkle et al. . | |
| 4,897,955 | 2/1990 | Winsor . | |
| 5,168,678 | 12/1992 | Scott, Jr. et al. . | |
| 5,283,994 | 2/1994 | Callison . | |

OTHER PUBLICATIONS

Declaration of Mark D. George (3pgs.); Jan. 27, 1998.

DesignWood Interlocking Timbers brochure, 1993.

*Primary Examiner*—Christopher Kent

*Attorney, Agent, or Firm*—Hovey,Williams, Timmons & Collins

[57] ABSTRACT

A modular construction system and modular member are provided for the construction of concatenated structures having interconnected, overlapping, offset or parallel courses. The modular members are provided with substantially planar upper and lower surfaces with the thickness, width and hole spacing of each modular member being predetermined and interdependent. The modular members present holes which receive connectors, and may have holes presenting a plurality of bore diameters. The members may be cut perpendicular to the longitudinal axis of the member midway between adjacent holes to provide compatible modular member segments. The complementally shaped connectors are received in the holes and may include mechanical barbs or threads, or separate retainers for use with the connectors inhibit preventing vertical separation of overlapping adjacent modular members. The system and method permit the construction of structures such as playhouses which have window and door openings and may include cupolas, elevated floors, roofs and stairs of interconnected modular members. Such structures are uniquely adapted for disassembly and rearrangement or expansion.

28 Claims, 21 Drawing Sheets

CONCATENATED STRUCTURES OF MODULAR MEMBERS

RELATED APPLICATIONS

This application claims priority under 35 U.S.C. §119(e) of Provisional Application Ser. No. 60/005,822 filed Oct. 23, 1995, entitled Modular Construction System, Method of Manufacture Thereof, and Method of Making Structures Therefrom, and the invention disclosed therein.

BACKGROUND OF THE INVENTION

1. Field of the Invention

This invention relates to a modular construction system and a corresponding method of erecting structures particularly useful for the average homeowner or "do-it-yourself" builder. More particularly, it is directed toward a prefabricated modular construction member which presents holes therethrough at particularly predetermined spacings to receive connectors, is adaptable to be cut into different lengths, and thereby enables rapid and precision assembly into a finished concatenated structure capable of future reconfiguration and expansion.

2. Description of the Prior Art

One of the favorite past-times of many homeowners is the tailoring of their residences and yards to meet their personal preferences and to express their own unique personalities and abilities. Although some people would prefer to hire professionals to do this work for them, there are many who would prefer to do such work themselves because of a sense of personal pride in the accomplishment of the task, to economize on the cost of the project, and for other reasons.

Among the many types of projects which may be undertaken are the design and building of concatenated structures such as planters, decks, children's playhouses, or storage facilities. These structures may enhance the beauty and value of the property and provide additional living and work space, as well as providing challenges and opportunities for personal expression. These projects are frequently constructed of lumber or rough timber as it is accessible and may be worked more readily than metal or stone. However, there are an increasing number of homeowners who lack the time, tools, talent or temperament necessary to tackle a construction project using dimension lumber or timbers as their starting material.

There have been many attempts in recent years to develop various premanufactured construction systems out of lumber products geared toward the average "do-it-yourselfer", particularly with large timbers such as landscape logs. In many instances, these products achieve noteworthy results, but in other instances fail to provide the working materials needed to achieve a particular goal.

One system heretofore developed is shown in U.S. Pat. No. 4,834,585, which uses a landscape timber module of a predetermined length and width with two flat surfaces and a plurality of uniformly spaced holes. This timber module is useful for constructing curvilinear berms and planters, but the single diameter hole without stopping means, long connectors requiring field fabrication in various lengths and lack of a module with only one hole significantly limits the usefulness of this module for above grade applications. The teaching of this invention does not recognize the advantages of arranging modules in overlapping, vertically spaced relationships nor does it recognize the advantages of using premanufactured, short, loose-fitting connectors which are either supplemented with mechanical connectors or specially adapted to resist vertical separation of the landscape timbers.

Both U.S. Pat. No. 4,897,955 and 5,168,678 disclose a landscaping structure with overlapping corner joints. These modules are useful for landscaping but are not readily adapted for creating openings between the timbers for playhouses and the like and may require irregular hole spacings or complex end shapes. U.S. Pat. No. 5,283,994 discloses another type of landscape timber utilizing a ball and socket joint to provide angled walls, but does not provide the ventilation or hole spacing which makes it readily adaptable to open construction.

Because of the complex shapes of the ends of the modules and/or the irregularities of the holes or spacings in the modules of these systems, the modules would need to be prefabricated in a number of different lengths. Field fabrication of complex shapes or particular spacings for a large quantity of modules in the various lengths which might be required by an end-user would defeat the module concept and not be practical. The necessity of fabricating, packaging, maintaining an inventory and selling modules of various lengths is a serious drawback to the economic viability of these systems and many other similar modular construction systems.

Currently, non-earth-contact structures such as children's playhouses are problems which present limited options for the do-it-yourself builder. Such a builder can either design and erect a structure from existing materials, such as landscape timbers or dimension lumber, or purchase and assemble a prefabricated kit. The option of designing and building a custom play structure definitely provides an opportunity for creative expression for the parent-builder, but as mentioned above, there are an increasing number of homeowners who do not have the time, tools, talent or temperament necessary for this option. The limited number of homeowners who do accept this challenge and complete a custom structure with conventional lumber products often find that the novelty of the static structure is soon gone, or the children may grow and require a larger playhouse.

Most parents thus resort to the option of purchasing a prefabricated structure or a kit with a multitude of different components and connecting hardware which can only be assembled into a single configuration. However, many children, like their parents, would prefer to express their individuality with a unique, customized playhouse, fort or clubhouse of their own making. The fancy "gingerbread" of a prefabricated plastic playhouse is no substitute for the personal satisfaction of expressing one's own budding engineering and construction talent. Another disadvantage of most prefabricated play structures is that they are typically fairly permanent structures which can only be assembled into a single configuration. Even the most elaborate of commercially available structures soon lose their novelty and are short-lived in their ability to fulfill the imagination and appetite of most children for new challenges and adventures.

There are also a number of different log-cabin type construction systems with various configurations of notched or specially designed interlocking ends which could be used for the construction of children's playhouses, but none of these have enjoyed very broad commercial success for playhouse applications. These systems typically have the same disadvantages as the aforementioned retaining wall systems. The specialized ends and/or other design features of the systems often require the end user to purchase a number of different lengths of factory fabricated components or expend a considerable amount of time and effort field fabricating connections. Additionally, these systems are generally limited to square or rectangular structures since the components can only be interconnected in an orthogonal relationship and many systems are limited to solid wall structures which do not allow for the introduction of natural light and ventilation and require considerably more components than concatenated structures with vertical spaces between parallel members. Finally, these structures have limited flexibility of redesign, or future modification or expansion.

U.S. Pat. No. 4,521,203 to Rothenburg disclosed a toy construction kit of kraft paper blocks or logs with notched ends which could be interlocked in orthogonal, vertically spaced relationships to create a playhouse with spaces between the logs. However, it may be appreciated that a structure constructed in accordance with the teachings of this patent has a number of limitations. The components of Rothenburg are made of a material (kraft paper) which is unsuitable for outdoor applications and weather conditions, especially when exposed to precipitation. These components have limited structural capabilities which limits the design flexibility of the system; that is, larger structures with multiple floor levels and large structural spans are not an option. Furthermore, these components can only be interconnected at their ends in overlapping, orthogonal, vertically spaced relationships which significantly limits the design flexibility of the system, preventing or inhibiting the use of angled or curved walls, sloping walls, stairs, roofs, or the like. In addition, cantilevering members to form overhangs, soffits, or the like is not possible. Finally, the system cannot be fabricated from a single article of manufacture, and requires components of particular lengths and configurations. Thus, separate purchase of exactly the right components is required, with inventorying and storage of both flat panels and components of various lengths.

SUMMARY OF THE INVENTION

The deficiencies of the modules and structures heretofore available are largely overcome by the present invention, which has as its objects:

- A modular construction system which may be used not only for landscaping applications but also for the construction of playhouses and other above-ground structures where an overlapping, spaced relationship between modules and the avoidance of placing modules both in an angled relationship and in abutment is desirable;
- A modular construction system with modules of various lengths, which may be easily fabricated by an end user from a single article of manufacture; and a single article of manufacture which can be economically mass produced, bundled, palletized and transported in a conventional manner without specialized packaging;
- A modular construction system in which the modules may have simple, squared ends which are more economical to manufacture than curved ends or ends with other complex shapes;
- A modular construction system in which longer modules may be easily converted by an end-user into one or more smaller modules by making simple perpendicular cuts;
- A modular construction system in which the modules are provided with holes designed to accommodate a variety of different connectors;
- A modular construction system which includes a short module or module segment having only one hole which may be used as a spacer between parallel, vertically spaced modules to form door and window openings in (life sized) concatenated structures accessible by children or adults;
- A modular construction system which permits the construction of a wide variety of (life-sized) accessible concatenated building structures with interesting features for the user which can be initially erected and later expanded or modified without building expertise by the ordinary do-it-yourselfer;
- A modular construction system which includes a premanufactured, short, pin connector of a uniform length permitting the initial assembly of modules into a concatenated structure without any tools and without the necessity of threading multiple layers of modules over excessively long connectors;
- A modular construction system and method of construction which, after an initial tool-free assembly with inexpensive pin connectors into a concatenated structure may be supplemented with a variety of retainers serving as mechanical connectors to enhance the structural stability of the final assembly;
- A modular construction system in which there is an alternate embodiment for a connector which may also be prefabricated in uniform lengths, installed by hand without tools and is capable of resisting not only horizontal, but also vertical displacement of interconnected modules;
- A modular member with predetermined cross-sectional dimensions and proportional relationships to hole spacing in order to create ergonomic, functional and aesthetic results desirable for playhouse applications;
- A modular construction system which may be fabricated out of relatively inexpensive and readily available materials such as landscape timbers, PVC pipe and threaded rods with associated washers and nuts;
- A modular construction system and method of construction which promotes an above grade application for peeler core landscape logs, for which they are actually much better suited. Although the current teaching in the art for peeler cores is directed toward direct earth contact applications, the heartwood of a typical peeler core does not readily or uniformly accept preservative treatments. Therefore most landscape logs are not warranted for direct earth contact applications.

The modular member of the present invention broadly includes a unitary, elongated body presenting a longitudinal axis between two opposed ends, at least two opposed substantially planar top and bottom surfaces extending along the longitudinal axis, and having preferably substantially planar ends oriented perpendicular to both the primary axis and the planar surfaces. Preferably, the modular member includes two opposed, arcuate-shaped sides interconnecting the top and bottom surfaces. The modular members may be milled from a unitary wooden timber or fabricated from a variety of synthetic materials. For example, the modular member may be formed of synthetic resin and molded or extruded to provide an elongated opening along the longitudinal axis. The module further includes a plurality of axially spaced holes aligned in coplanar relationship and oriented perpendicularly to the top and bottom surfaces and extending therebetween. The holes are preferably centered to extend through the longitudinal axis, the holes being positioned at evenly spaced intervals, preferably at a consistent, predetermined interval determined and dependent upon the thickness and width of the module.

The holes may be provided in various configurations including a straight cylindrical bore to accommodate a dowel or pin type connector, a pair of larger bores interconnected by a smaller, intermediate and centered bore to receive a tube or dowel of shorter length, or a hole presenting an intermediate region of increased dimension to receive a mechanical locking connector. This intermediate region may be a bore of greater diameter aligned coaxially with smaller bores extending to the upper and lower surfaces, or the longitudinally extending opening may serve as the intermediate region and communicate with the bores extending to the upper and lower surfaces of the modular member.

Connectors are provided as a part of the system which are complementally configured to the particular configuration and size of the opening. Connectors may include a pin presenting tapered ends and an enlarged annular shoulder intermediate the ends, a tube, a half-spaced connector with two short connector segments spaced one hole spacing apart on one side of a plate and one short connector segment spaced half way therebetween on an opposite side, or a locking connector presenting a plurality of independently flexible fingers presenting outward engagement shoulders surrounding a central open region. A separate retainer, made of spring wire or the like, may be used as well as a variety of more basic retainers such as threaded rods, bolts and lag screws to accomplish the retention function.

The modular construction system as disclosed herein further includes a method of construction and structures erected using the modular members and connectors. The system hereof uses uniformly manufactured components which are versatile permitting flexibility in use. The system includes both permanent and temporary structures and both earth-contact structures with a portion beneath the grade, as well as above-grade structures. Currently, CCA treated landscape logs are used almost exclusively for permanent direct earth contact applications such as retaining walls, planter boxes, landscape edging, etc. and the current teaching in the art is geared in this direction. One of the reasons that landscape logs have not been used extensively for other applications is that they are prone to warping and twisting if they are not securely anchored, yet they cannot be easily secured with typical fasteners such as nails and screws. Ironically, most landscape logs are made from heartwood, which does not readily or uniformly accept preservative treatments and are therefore not rated for direct earth-contact applications. It has been discovered that by adapting these logs with holes as disclosed in this invention and then assembling them with loose fitting connectors in alternately overlapping layers in a spaced relationship, that these previous limitations are largely overcome. The initial assembly of a structure using the modular members of the current invention may be easily accomplished without tools and modular members assembled in accordance with the teaching of the present invention are securely anchored in a manner which resists their natural inclination for twisting and warping. The result is a new use for this raw material for which it is actually much better suited.

The structures are particularly well suited for use as children's play houses where the simplicity and adaptability of the module and connector system produce unexpected results and advantages which were previously unappreciated, such as enhanced ventilation and safety. Structures utilizing the modules and connectors in accordance with the present invention are not limited to indoor use, and may be erected using multiple floors and a variety of plan configurations. Larger structures with long structural spans and multiple floor levels, as well as the availability for future expansion are readily constructed. Thus, the user who begins with a relatively simple structure may change or expand a playhouse or the like through later incorporation of the modular components with corresponding design flexibility either during initial construction or later adaptation. Enhanced visibility and ventilation may be readily obtained by overlapping the components, while maintaining the flexibility to incorporate sloping walls, stairs, roofs or cantilevered structured features as individually desired.

Thus, a unique advantage of the present invention in playhouse applications is that the components can be purchased incrementally and playhouse structures can be adapted or expanded as the children mature. For example, a family can make a small investment and construct a single-room toddler scaled structure initially. Additional components can be purchased at a later date and the structure can be reconfigured into a larger multi-room structure for elementary aged children. Still later, the structure may be expanded into a multi-story structure with integral stairs appropriate for adolescent aged children. Eventually, when the children outgrow playhouses all together, the modules can be reconfigured into a gazebo, a storage shed, a compost-retaining structure, or a wide variety of other outdoor structures or landscaping applications.

These and other advantages of the present invention can be readily appreciated by one skilled in the art with reference to the following description and the drawings hereof.

DESCRIPTION OF THE PREFERRED EMBODIMENT

Figure 3A:
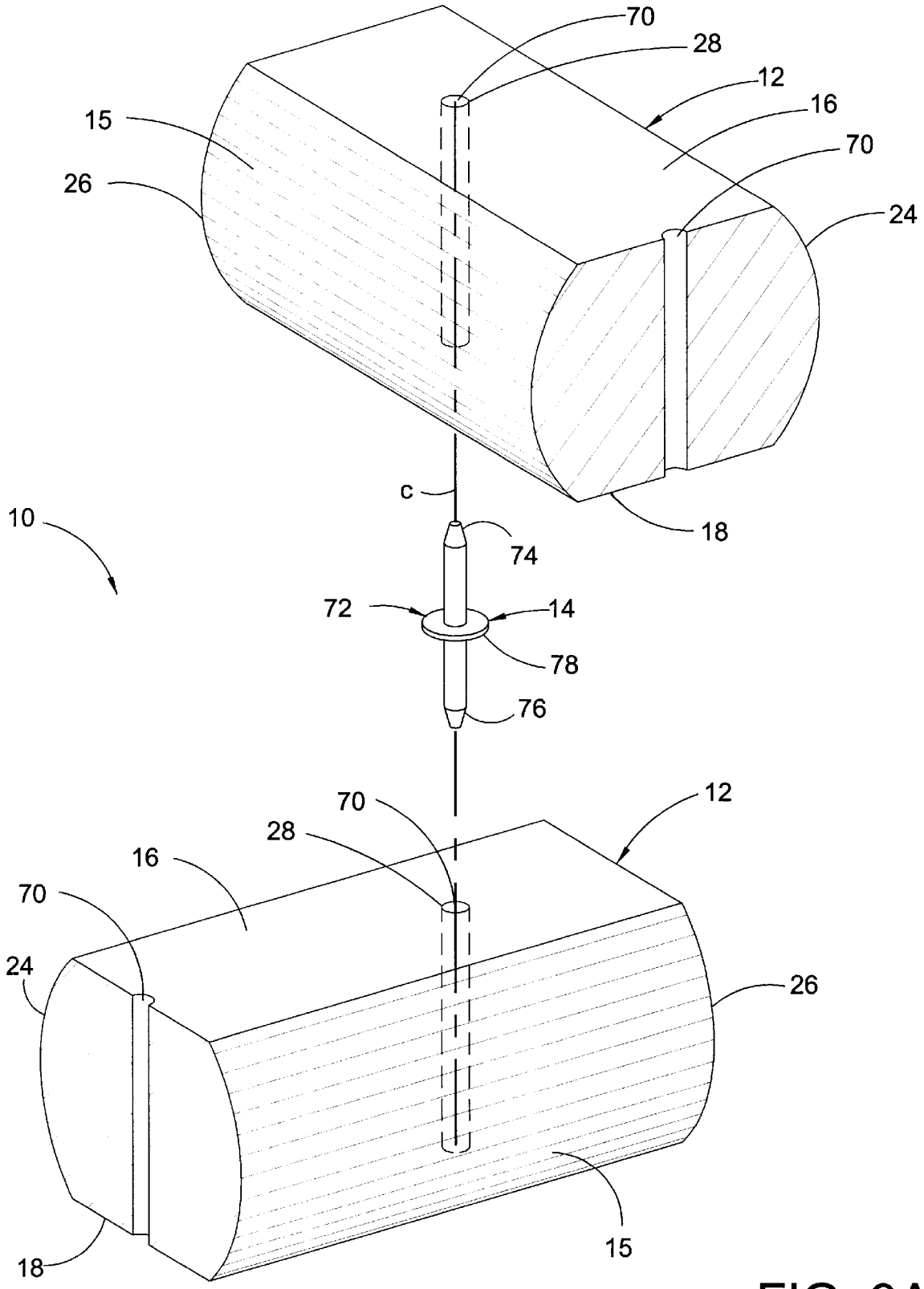
FIG. 3A is an exploded isometric view taken in partial cross-section through holes of each of the modules of the present invention showing the use of a pin connector with tapered ends and a centrally located stop flange.

Referring now to the drawings, FIG. 3A illustrates one preferred modular construction system 10 in accordance with the present invention which broadly includes a modular member 12 and a connector 14. As used herein, the reference character 12 is intended to refer to the modular member regardless of the particular length, and the reference character 14 to refer to any of the articles disclosed which connect two or more adjacent modules against relative shifting along any axis. While the modular member components may be assembled in overlying, adjacent, superposed relationship to create landscaping structures where minimum clearance and thus permeability between adjacent modular members is desired, the modular member 12 hereof is uniquely adapted to above-ground structures where overlapping members 12 are placed at an angle or, more particularly, orthogonally to one another.

Figure 1A:
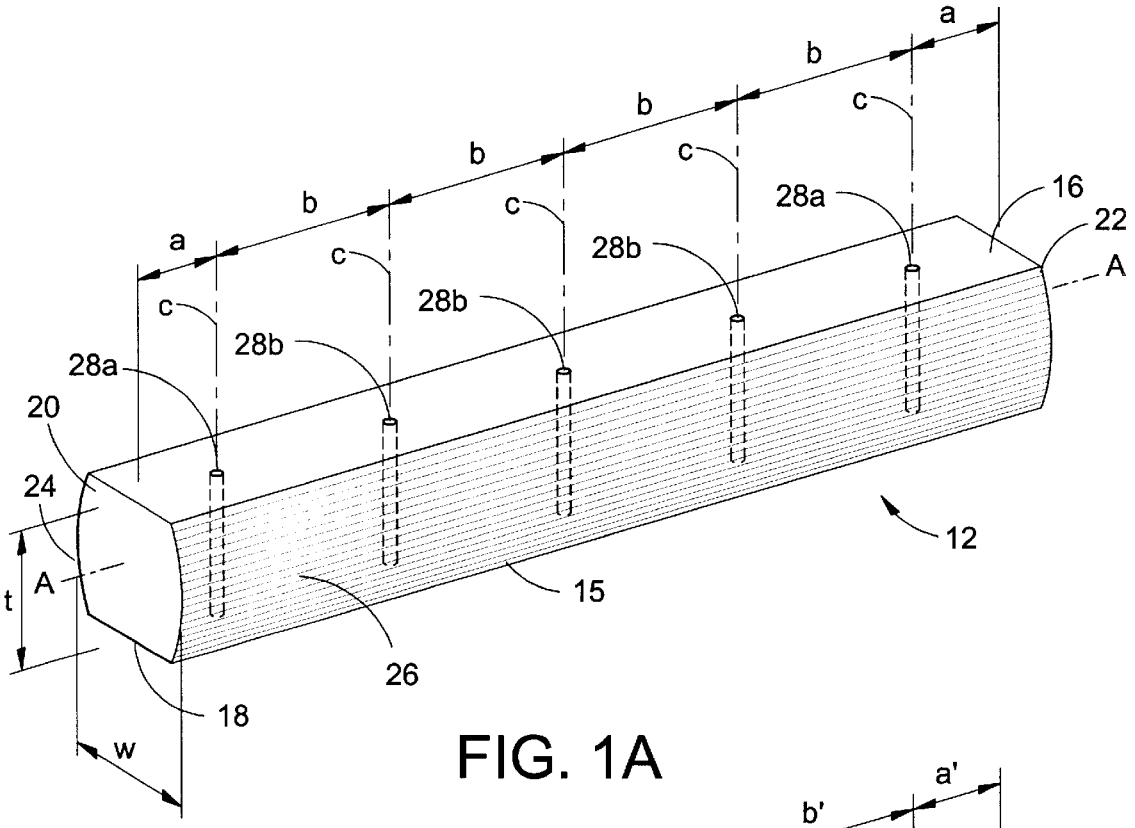
Figure 1A is an isometric view of a preferred embodiment of a modular member in accordance with the present invention showing the use of five transversely extending connector-receiving holes.

As shown in FIG. 1A, the modular member 12 is preferably formed of a unitary body 15 of seasoned wood which has been sufficiently dried to prevent warpage. The body 15 preferably presents a substantially planar upper surface 16, and opposed, parallel, substantially planar lower surface 18 defining a thickness "t" therebetween, and a pair of opposed planar ends 20,22 cut perpendicular relative to the upper and lower surfaces to define a length "L" therebetween. Each of the surfaces 16 and 18 preferably extend the length L. In addition, the body 15 presents a pair of opposed arcuately-shaped sides 24,26 defining a width "w" therebetween. The width w of the modular member 12 is understood herein as the maximum distance between the sides 24 and 26, while the width of the surfaces 16 and 18 is understood as the minimum distance between the sides 24 and 26, and is preferably at least about three inches. Each of the sides 24, 26 present a convex surface with a radius greater than one-half the width w of the modular member 12. The modular member 12 is preferably provided, at least initially, as a unitary, elongated timber presenting a longitudinally-oriented axis A centrally located therealong. In the embodiment shown in FIG. 1A, the modular member 12 presents a thickness t of 3 inches with an exemplary width w of 3¾ inches. Further, the surfaces 16 and 18 each have a width of about 3 inches.

The member 12 preferably presents at least one hole 28 extending transversely to the longitudinal axis A, with longer segments or full length modular members including a plurality of holes 28 longitudinally spaced along the length of the member 12 and bored at pre-selected intervals therealong. The holes 28 may be provided in various configurations as disclosed herein and are centered and aligned along the longitudinal axis A whereby their individual central axes C are coplanar and bisect the width w as may be seen in FIGS. 2A through 2G and in the embodiment FIG. 1A. The holes 28 extend the entire thickness of the member 12 to communicate with the upper surface 16 and the lower surface 18. The holes 28 are aligned along axis A—A and oriented with their central axes C perpendicular thereto.

Figure 1B:
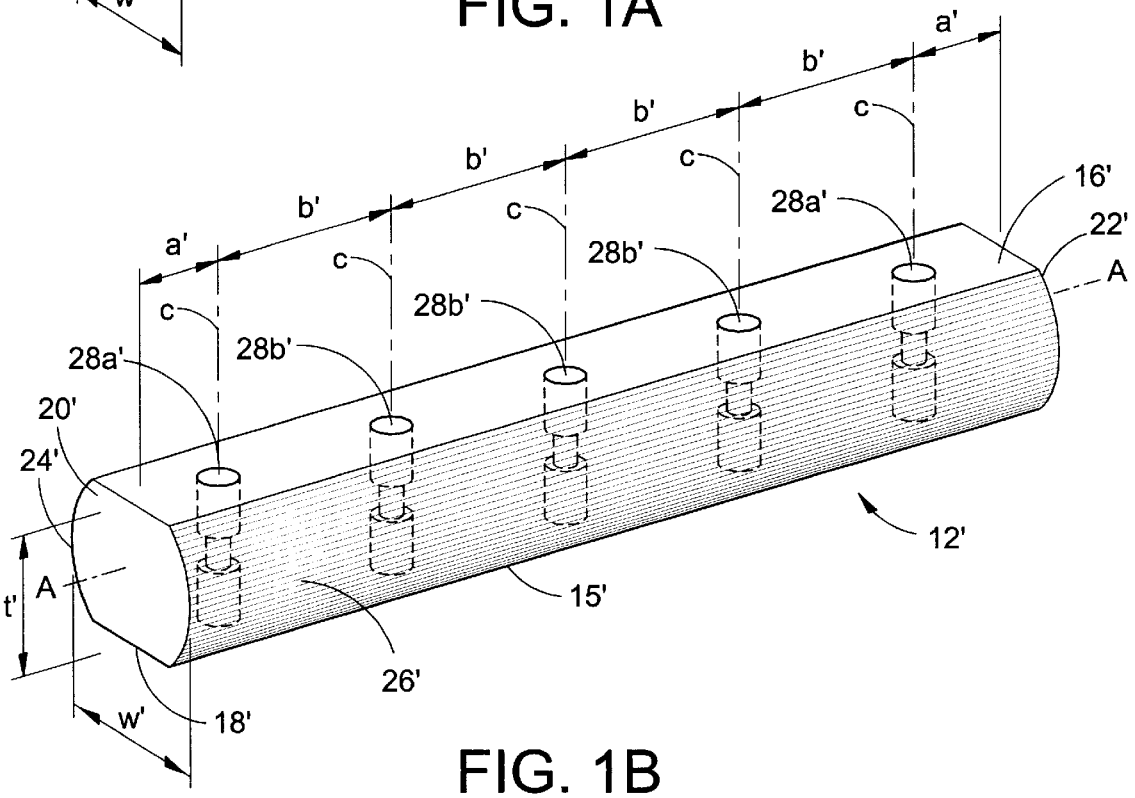
FIG. 1B is an isometric view of a first alternate embodiment of the modular member hereof similar to FIG. 1A.
Figure 1C:
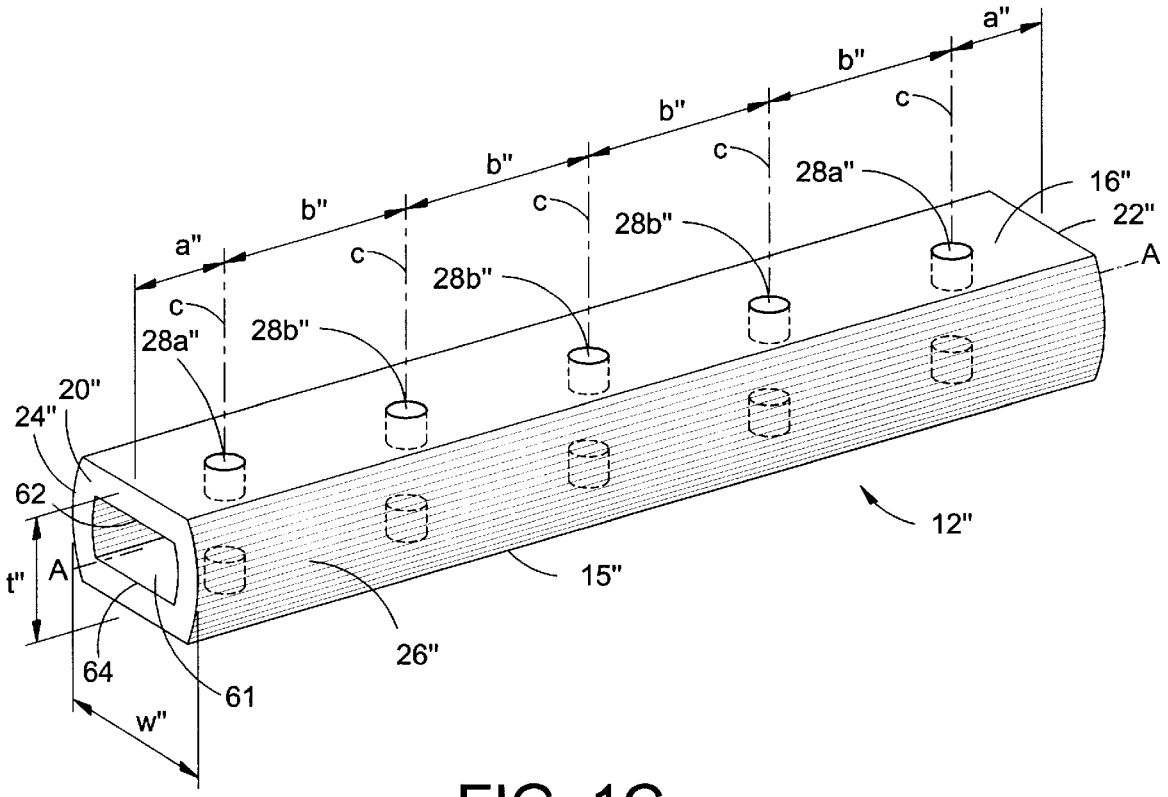
FIG. 1C is an isometric view of a second alternate embodiment in which the modular member is fabricated from an extrusion of a synthetic material presenting an elongated open space along its longitudinal axis.
Figure 2A:
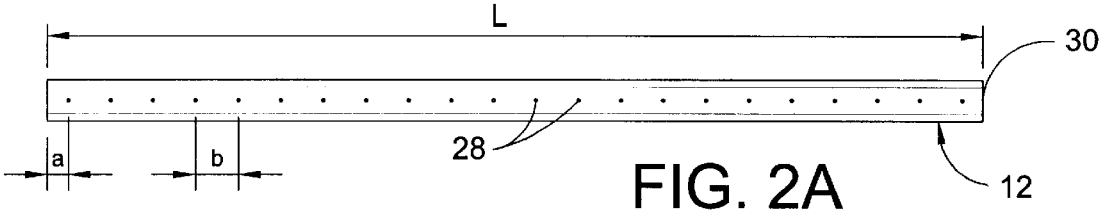
FIG. 2A is a top plan view of an exemplary full length modular member showing one possible hole spacing and from which modular members in varying lengths similar to FIG. 1A may be fabricated.
Figure 2B:
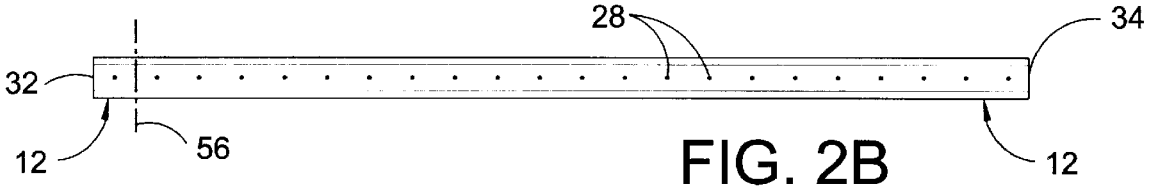
FIGS. 2B through 2G are top plan views of the full length modular member FIG. 2A, with perpendicular cut lines at desired intervals for providing modular members shortened into segments for use as structural components as shown in FIG. 1A.
Figure 2C:
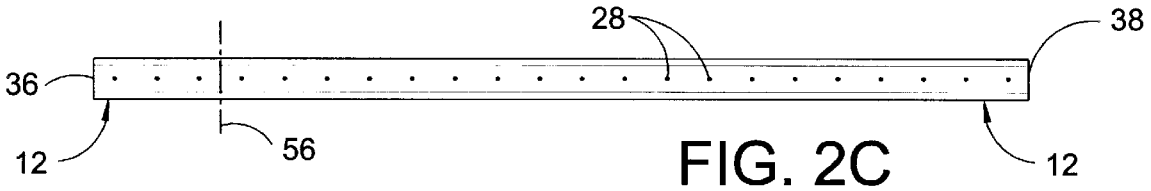
Figure 2D:
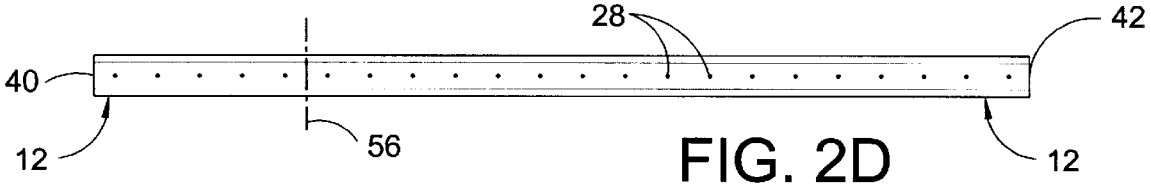
Figure 2E:
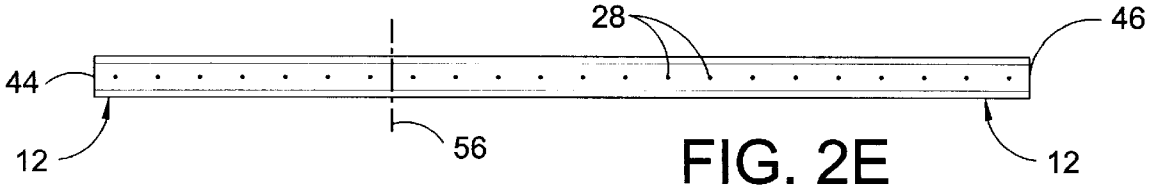
Figure 2F:
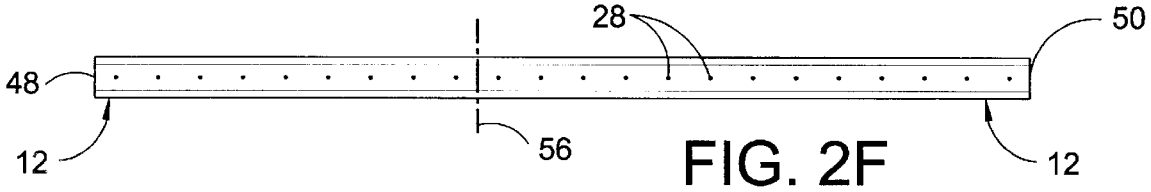
Figure 2G:
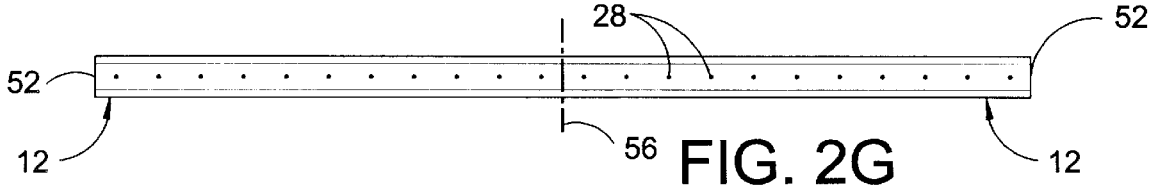

The spacing of the holes 28 of the modular member 12 is illustrated in FIGS. 1A, 1B and 1C, and in FIGS. 2A–2G wherein it may be seen that the holes 28*a* adjacent each of the ends 20,22 respectively, are spaced a distance "a" from the adjacent end. The holes 28*b* intermediate holes 28*a* are spaced a distance "b" from each other and from holes 28*a*. Preferably, the dimension b is equal to the width w of the modular member 12 plus an additional spacing of ⅛ inch to one half inch, and more preferably ⅛ inch to ¼ inch. Distance a is slightly less than half the distance b measured center to center between the central axes C of two adjacent holes 28*a* and 28*b*. That is to say, the distance a is equal to the distance b minus half the width of the kerf removed during cutting of the ends 20,22. This ratio between the distances a and b is present in the starting full-length modular member 30 as shown in FIG. 2A and is maintained in the modules individually fabricated of different lengths 32, 34, 36, 38, 40, 42, 44, 46, 48, 50, and 52 as shown in FIGS. 2B through 2G, each of the different lengths being obtained by a perpendicular cut 56 as illustrated in each of FIGS. 2B through 2G. In the embodiment shown in FIG. 1A, the hole spacing b is shown as 4 inches, thereby providing a ratio of t/b of 3 to 4.

Figure 7A:
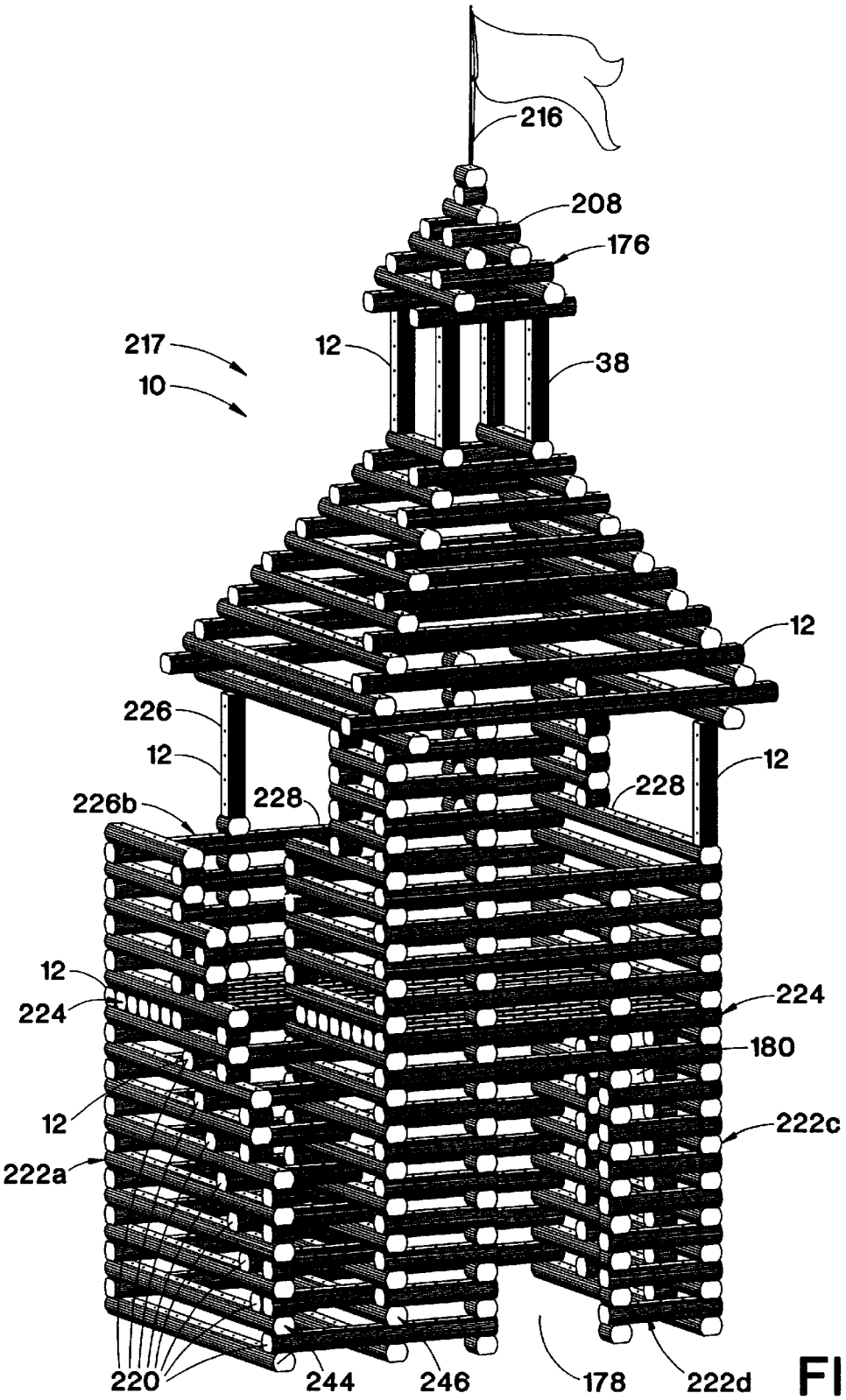
FIG. 7A is an isometric view of an exemplary two-story playhouse constructed of interconnected modules in accordance with the present invention, showing the construction of stairs, an upper floor, and hip roof structures by the interconnected modules.

The holes 28 are desirably spaced evenly along the length of the full length modular member. In this manner, the length of the full-length modular member 30 would be a multiple of the number of holes. Another consideration for the hole spacing is the ratio between the thickness t of the full-length module 30 and the hole spacing, where a common multiple of the hole spacing would be approximately equal to a predetermined multiple of the thickness t of the modular member 12. The correlation between the hole spacing and the thickness of the modular member 12 permits modules 12 with a predetermined number of holes 28 and of a desired length to be used in a vertical orientation as illustrated in FIG. 7A as posts or columns between multiple layers of modules arranged in stacked horizontal arrangement.

It may be appreciated that the full length module 30 may be of a number of desired lengths L, thicknesses t, and widths w. However, lengths of 8 to 10 feet and thicknesses of 2.5 inches to 3.5 inches are preferred, with the thickness t more preferably in the range of 2.75 to 3.25 inches. When modular members 12 are placed in an overlapping relationship with one another in alternating orientations, the vertical distance from the top surface 16 of one modular member 12 to the top surface 16 of an adjacent modular member 12 in the same orientation is an ergonomically appropriate riser height for stairs. Also, this thickness t reduces the risk of entrapment of children between modules. It is also preferable if certain common multiples of this thickness may be used in structures to create appropriately scaled window heights, door heights, ceiling heights, guardrail heights, seat heights, etc.

As depicted in FIG. 2A, an illustrative full-length module 30 is shown, and may have a length L of 96 inches and be provided with twenty-two holes 28. A length of 96 inches is especially useful because solid wood timbers with this length and a corresponding cross sectional configuration may be readily treated with a preservative compound such as chromated copper arsenate (CCA) and are readily available for conversion in nominal eight foot lengths for landscaping. Holes 28 may be bored in various configurations and shapes, such as shown in FIGS. 1A, 1B, 1C, 3A, 3B, and 3D. The spacing between the holes may be, for example 4.37 inches, which equals 96 divided by 22.

An alternate embodiment of the module 12 is shown as 12' in FIG. 1B. In this embodiment, the starting raw material for the body 15' is a peeler core of wood. The cross-sectional configuration is similar to module 12 shown in FIG. 1A, but the radius of each of the arcuate sides 24' and 26' is approximately equal to half the width w of the modular member 12'. An alternative hole configuration 28' is provided and the thickness t is about 2.91 inches, the width w is about 4.25 inches, and the center-to-center hole spacing b is about 4.37 inches, thereby yielding a ratio of t/b of 2 to 3. The spacing a between the end and the adjacent hole is 2.12 inches or about ½ b.

A further alternate embodiment of the modular member 12 is shown in FIG. 1C as modular member 12". Modular member 12" is preferably molded of a synthetic resin material such as polyethylene or polyvinyl chloride (PVC) and includes an elongated, axially aligned open space 61 which extends the length L of the member 12" and communicates with the holes 28". The open space 61 is illustrated as of a similar cross-sectional configuration to the overall cross-sectional area of the modular member 12", which thereby advantageously presents flat upper surface 62 and flat lower surface 64 defining the thickness of the open space 61. The open space 61 reduces the weight of the member 12" and avoids the necessity of holes of complex configurations using connectors with retainers as described hereinafter. In the embodiment shown in FIG. 1C, the diameters of the holes 28" are shown to be simple bores of ⅞ inch inside diameter with a hole spacing being 4.8 inches center-to-center. The thickness t is shown to be 3 inches and the width w 4.6 inches to present a t/b ratio of 5 to 8.

Different configurations of the holes 28 for members 12, 12' or 12" may be provided, as shown in FIGS. 3A, 3B, 3C and 3D, and different connectors may be provided which are complemental to the holes.

FIG. 3A illustrates a hole 28 which is a cylindrical bore 70 extending through the thickness t to communicate with upper surface 16 and lower surface 18. Although the holes may be of various sizes, the holes illustrated in this embodiment are ⅜ inch diameter. This hole size is easy and economical to produce and useful with a variety of connectors. One connector 14, as shown in FIG. 3A, presents an elongated pin 72 having opposed tapered ends 74 and 76, with an annular stop flange 78 located intermediate the ends 74 and 76. The stop flange 78 is oriented in a plane transverse to the longitudinal axis of the pin 72 and may be useful in centering the pin 72 between two overlapping or interconnected modular members 12.

Figure 3B:
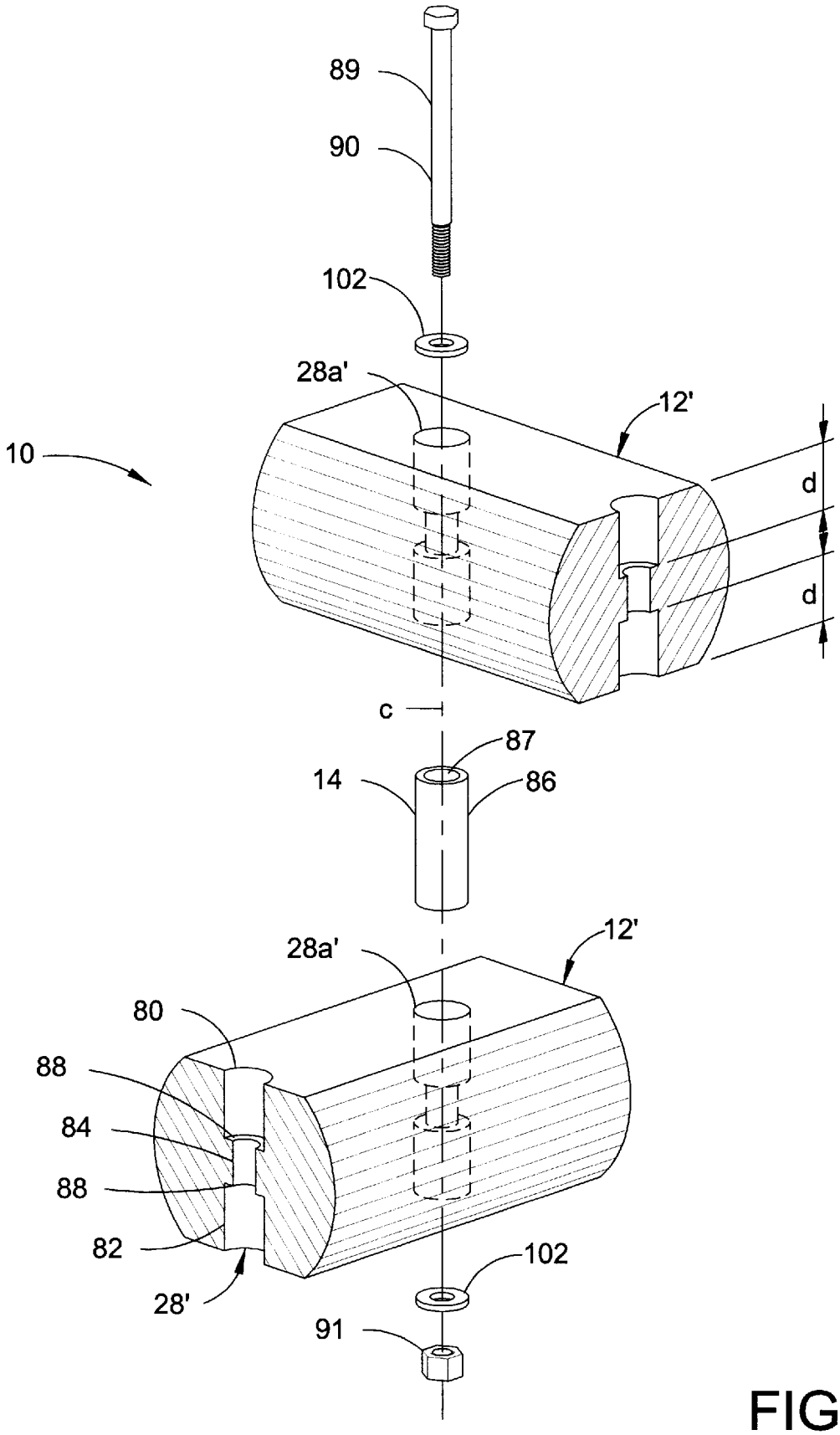
FIG. 3B is an exploded isometric view similar to FIG. 3A showing a first alternate configuration of the holes for receiving complemental tube-type module connectors and showing a bolt with associated washers and nuts as a retainer for mechanical securement of adjacent modular members.

FIG. 3B illustrates a second embodiment of hole 28, denominated herein as hole 28'. Hole 28' presents an upper bore 80 and lower bore 82 of an enlarged diameter relative to intermediate bore 84. The bores 80 and 82 are substantially circular in cross-section and complementally sized to receive tubular connector 86 therein. Preferably the diameter of bores 80 and 82 would be approximately 1/32–1/16 inch larger than the outside diameter of connector 86 to permit easier registration and insertion of the connector. It may be seen that connector 86 is tubular and circular in cross-section presenting a central axial opening 87. Connectors 86 should be prefabricated from a rigid, durable and non-corrosive material capable of resisting normal lateral forces anticipated to be placed on the structure. It has been found that segments of standard PVC pipe which are readily available and very inexpensive are ideally suited for this embodiment.

Bores 80 and 82 extend a depth d which is less than half and more preferably approximately 40% of the thickness t of the modular member 12. Connector 86 has a length greater than depth d and preferably approximately ⅛ inch less than twice the thickness of d. Any length greater than twice d will result in vertical separation between overlapping modular members, wherein all of the weight of overlying modular members will be supported by the connectors 86.

The interconnecting intermediate bore 84 of the modular member 12' shown in FIG. 3B thus presents a shoulder 88 at the junction with the adjacent upper bore 80 and lower bore 82 to provide a means for stopping and properly positioning the connector 86 between the two interconnected overlapping modular members 12. Preferably the width of the shoulder 88, defined as the difference between the radius of the upper and lower bores 80,82 and intermediate bore 84, should be approximately 3/16 inch. The shoulder 88 also permits the use of a retainer 90 for inhibiting separation of interconnected adjacent members along the axis C. Retainer 90 is shown as a bolt 89 presenting a threaded shank and held against axial movement by washers 102 and nut 91. Retainer 90 may also include a wide variety of conventional mechanical fasteners such as threaded rods, bolts, lag screws, and other threaded fasteners, or a variety of specially designed fasteners to interconnect and resist both horizontal and vertical movement of any overlying modular members 12 which are not adequately restrained from movement by the superimposed weight of other modules.

The enlarged upper bore 80 and lower bore 82 also permit the ends of conventional fasteners such as the heads of bolts 89, washers 102 and nuts 91 to be recessed when used as or with connectors, and provides additional design options for the do-it-yourselfer by readily accommodating longer segments of tubing, dowels or the like. Multiple sections of elongated tubular or solid cylindrically shaped elements may be inserted between parallel modular members to form balusters, ladder rungs, or protective barriers. The enlarged upper and lower bores 80 and 82 are also ideally suited as receptacles for flagpoles and handrails, which are very desirable features for playhouse applications.

Figure 3C:
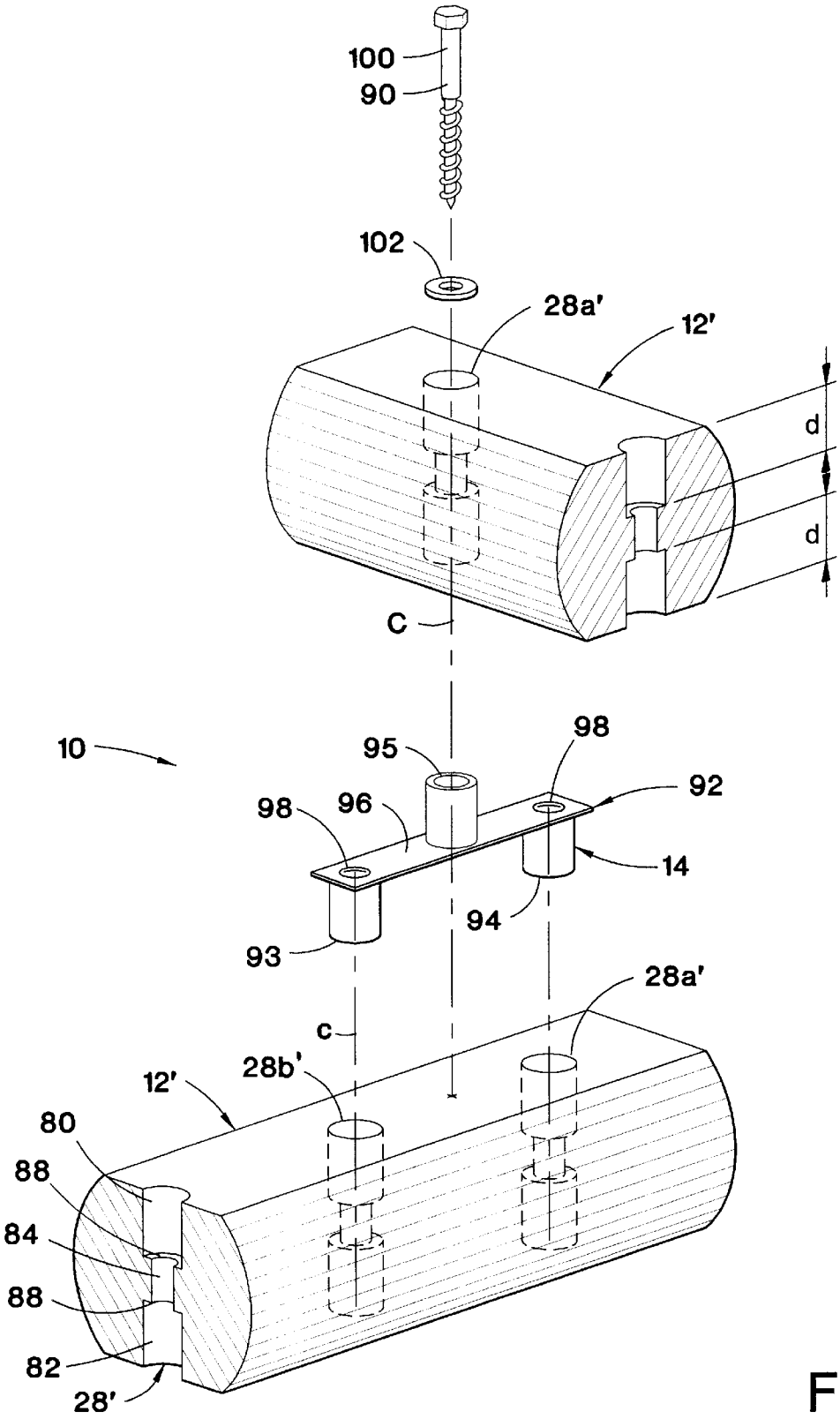
FIG. 3C is an exploded isometric view in partial cross-section of the modular member system showing a modular member with the hole configuration shown in FIG. 3B and a half space connector, and using a lag screw as a retainer to secure adjacent modular members.

FIG. 3C illustrates an alternate embodiment of connector 14 which is designated as complimentary configured connector 92. This "half-space" connector 92 is uniquely adapted for adjusting the placement of successive courses of modular members 12 at increments of one half the normal hole spacing to provide the modular construction system with even greater design flexibility. Half-space connector 92 includes a thin flat bar 96 presenting two tubular segments 93 complementally configured for insertion a hole 28' spaced with their central axes a distance b apart on one side thereof and another tubular segment 95 on the opposite side of the bar 96 having its axis spaced intermediate and approximately ½ the hole spacing b from the axes of each of the tubular segments 93, 94. A lag screw 100 with washer 102 is illustrated as an optional supplemental retaining means. However, mechanical securement is typically not required unless these connectors 92 are used near the top of a structure.

Figure 9A:
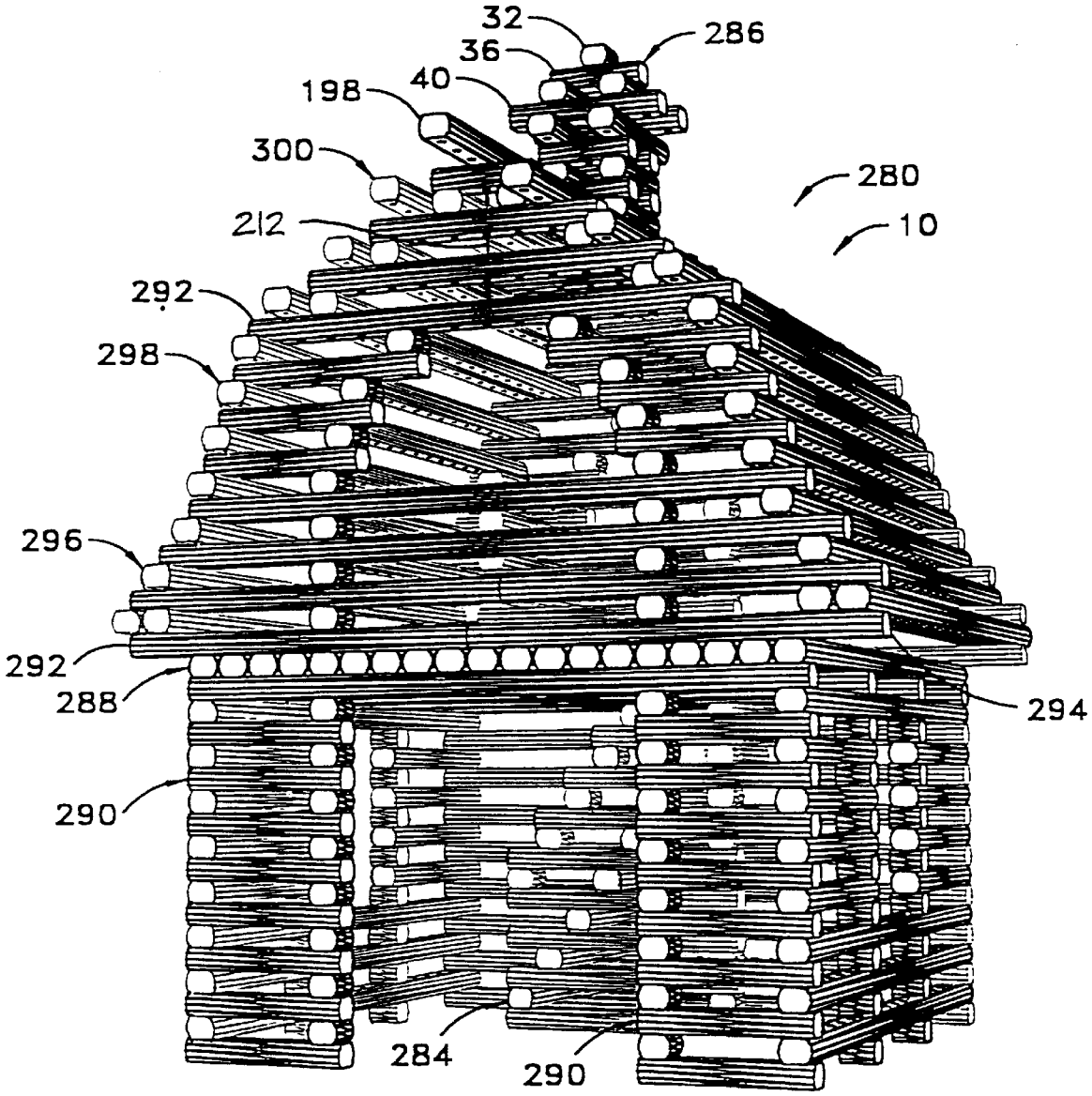
FIG. 9A is a perspective view of an exemplary two story playhouse constructed of interconnected modular members in accordance with the present invention, showing the use of the half-spaced connector shown in FIG. 3C to create a structure with a steeper roof slope and an alternate embodiment of a cupola without any modular members in a vertical orientation.
Figure 9B:
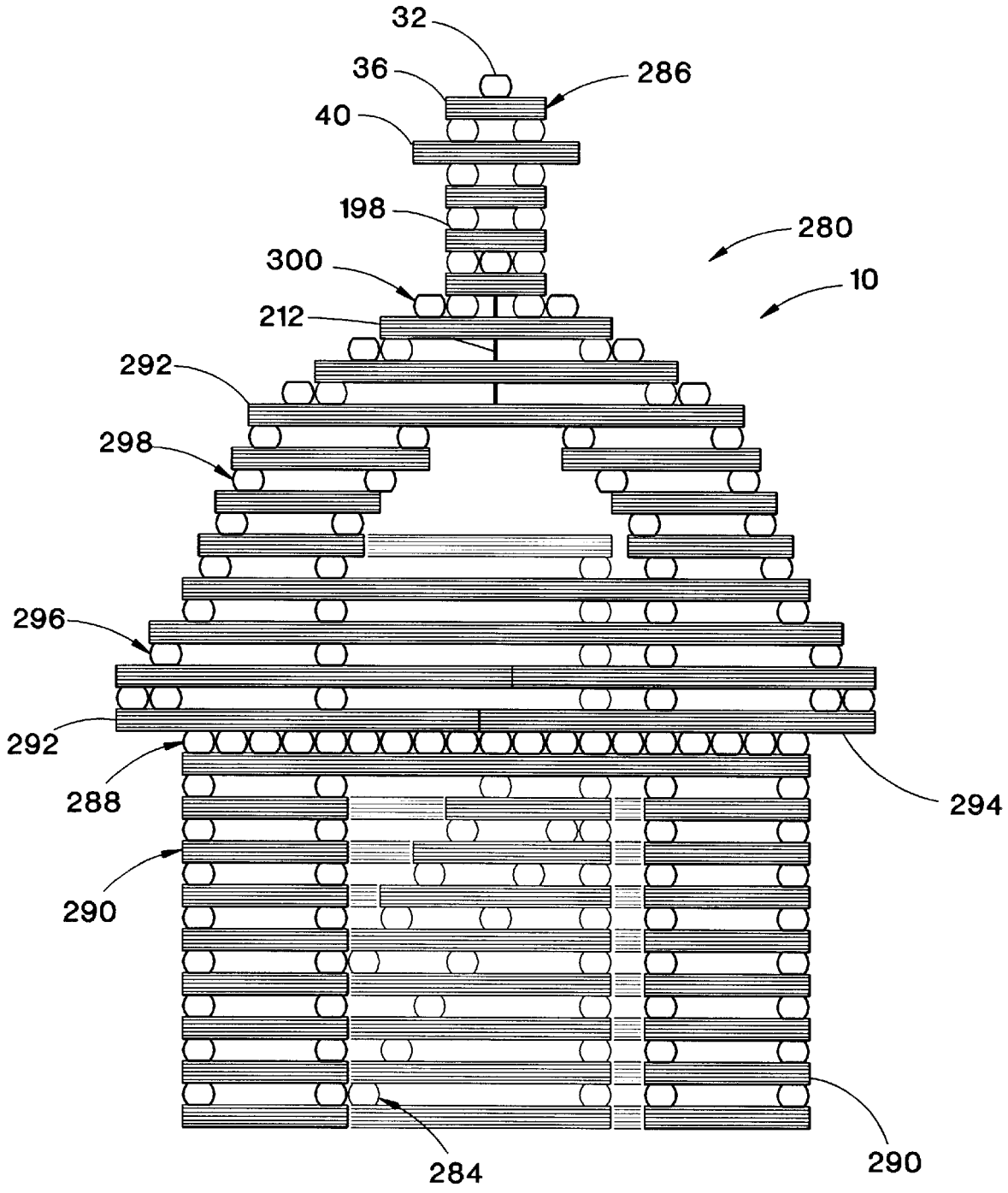
FIG. 9B is a front elevation thereof.

Connector 92 permits the construction of stairs, roofs and other sloping elements at angles of 1.33 t/b and 4 t/b in addition to the t/b and 2 t/b slopes which are possible with the other connector embodiments. The use of this connector embodiment to achieve a steeper roof with a slope of 4 t/b is illustrated in FIG. 9A and 9B. Another advantage of the half-space connector 92 is that it permits a symmetrical transition from modular members 12 with an even number of holes to a modular member 12 with an odd number of holes. For example, in a structure in which the exterior walls are of an even module length of 16b, a pair of connectors 92 may be used to transition to a modular member 34, with 21 holes, with an equal overhang width of 2.5 b on each side.

Connector 92 may be formed by casting or molding of a rigid material such as metal or plastic or a combination of the two materials. Preferably the flat bar 96 should be less than 1/16 inch in thickness. The tubular segments 93, 94 and 95 may be made of PVC pipe and may be attached to bar 96 with hollow metal tubular elements 98 flared out at both ends to compress and secure the tubular segments 93,94, and 95 to the flat bar 96.

Figure 3D:
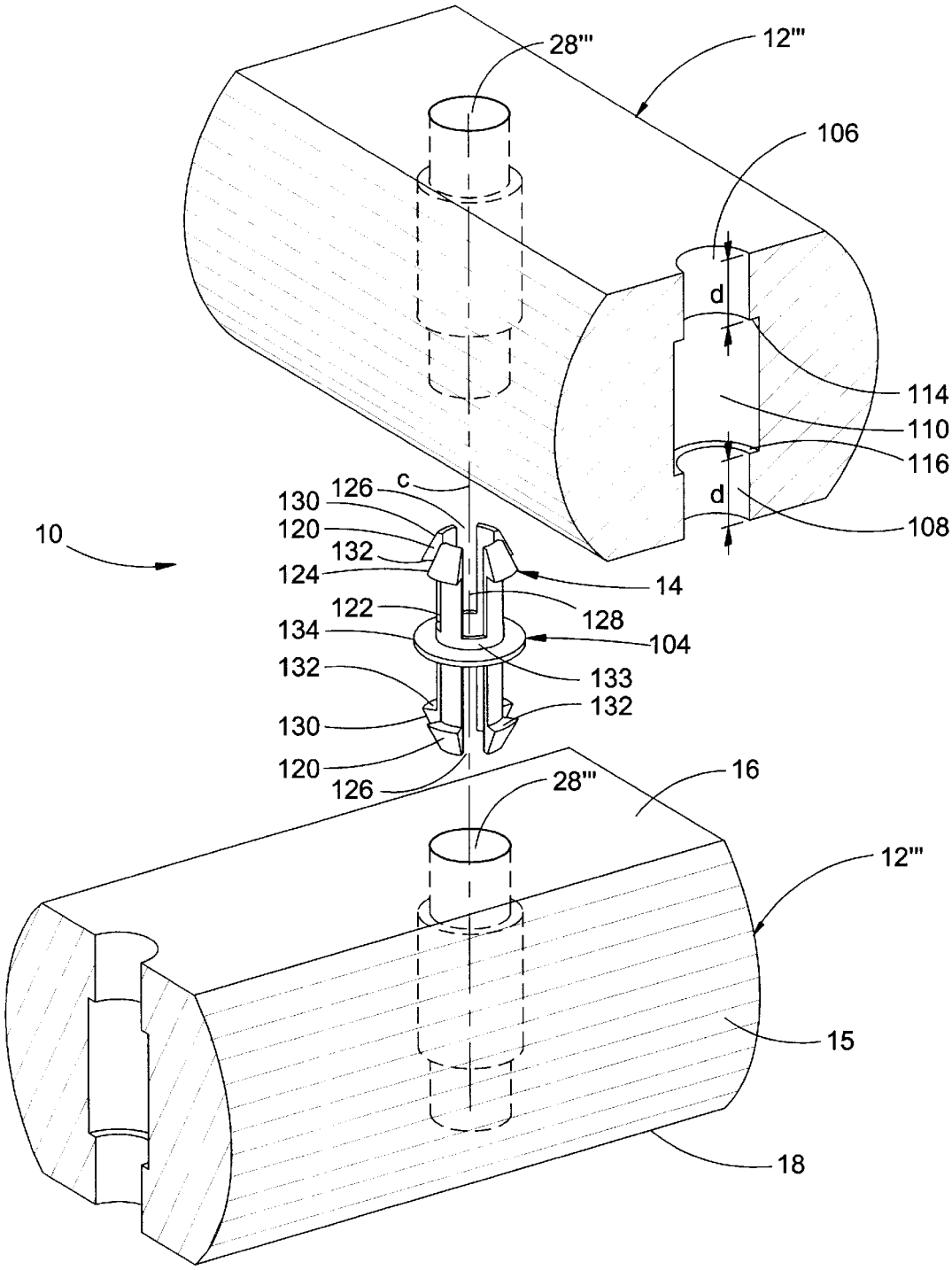
FIG. 3D is an exploded isometric view similar to FIG. 3A showing a second alternate configuration of the holes for receiving a combination connector-retainer with resilient legs for mechanical engagement with the modular member in enlarged recessed openings of the holes.

A third alternative embodiment of the hole 28 and modular member 12 are shown in FIG. 3D as hole 28''' and modular member 12'''. Hole 28''' is illustrated in FIG. 3D specifically adapted for use with a mechanically engaging connector 104 which is configured to also include retaining means. Hole 28''' presents vertically aligned upper bore 106 and lower bore 108 positioned respectively adjacent upper surface 16 and lower surface 18. A cylindrically shaped receiving space 110 is positioned respectively inwardly and thus intermediate of upper bore 106 and lower bore 108, that is to say, receiving space 110 is aligned with, and shares a common central axis C with upper bore 106 and lower bore 108, and is located respectively below and above upper bore 106 and lower bore 108. Receiving space 110 is circular in cross section and has a diameter greater than the diameters of upper bore 106 and lower bore 108, thereby presenting engagement rims 114 and 116, respectively.

Hole configuration 28''' and modular member 12''' when used with the connector 104 are functionally equivalent in that the receiving space 110 serves to receive the mechanically engaging barbs in the same manner as the open space 61 of the modular member 12" shown in FIG. 1C. That is to say, as previously described in conjunction with FIG. 1C a functionally comparable enlarged receiving space and engagement rims may be created much more easily if the starting raw material for the modular members contains a continuous longitudinal void, with upper bore 106 and lower bore 108 being similarly dimentioned to upper bore 80 and lower bore 82.

Connector 104 is preferably molded of a resilient synthetic material and presents a plurality of flexible fingers 120. Each of the flexible fingers 120 includes a stretch 122 which is longer than the corresponding depth d of bores 106 and 108 whereby engagement barb 124 may be received within a respective receiving space 110. The fingers 120 are preferably presented in a circular array presenting a central opening 126 therebetween. A slot 128 is presented between adjacent fingers 120 to permit individual flexibility of the fingers 120 and, in combination with the central opening 126, enable the fingers 120 to be deflected inwardly toward the opening 126 in unison. It may be seen from FIG. 3D that the barb 124 includes beveled surface 130 oriented at an angle to the sides of the bores 106,108 when inserted therein, and a face 132 which lockingly engages with the respective engagement rims 114,116. The connector 104 also preferably includes a waist 133 carrying an annular flange 134. The waist is preferably open to present a central passageway which connects with central opening 126 in the event the user may later wish to permit the passage of a dislocating tool therethrough. Such a tool may serve to compress the barbed fingers when inserted through the center of the connector so that adjacent interconnected modular members 12" may be disengaged and separated.

Figure 4A:
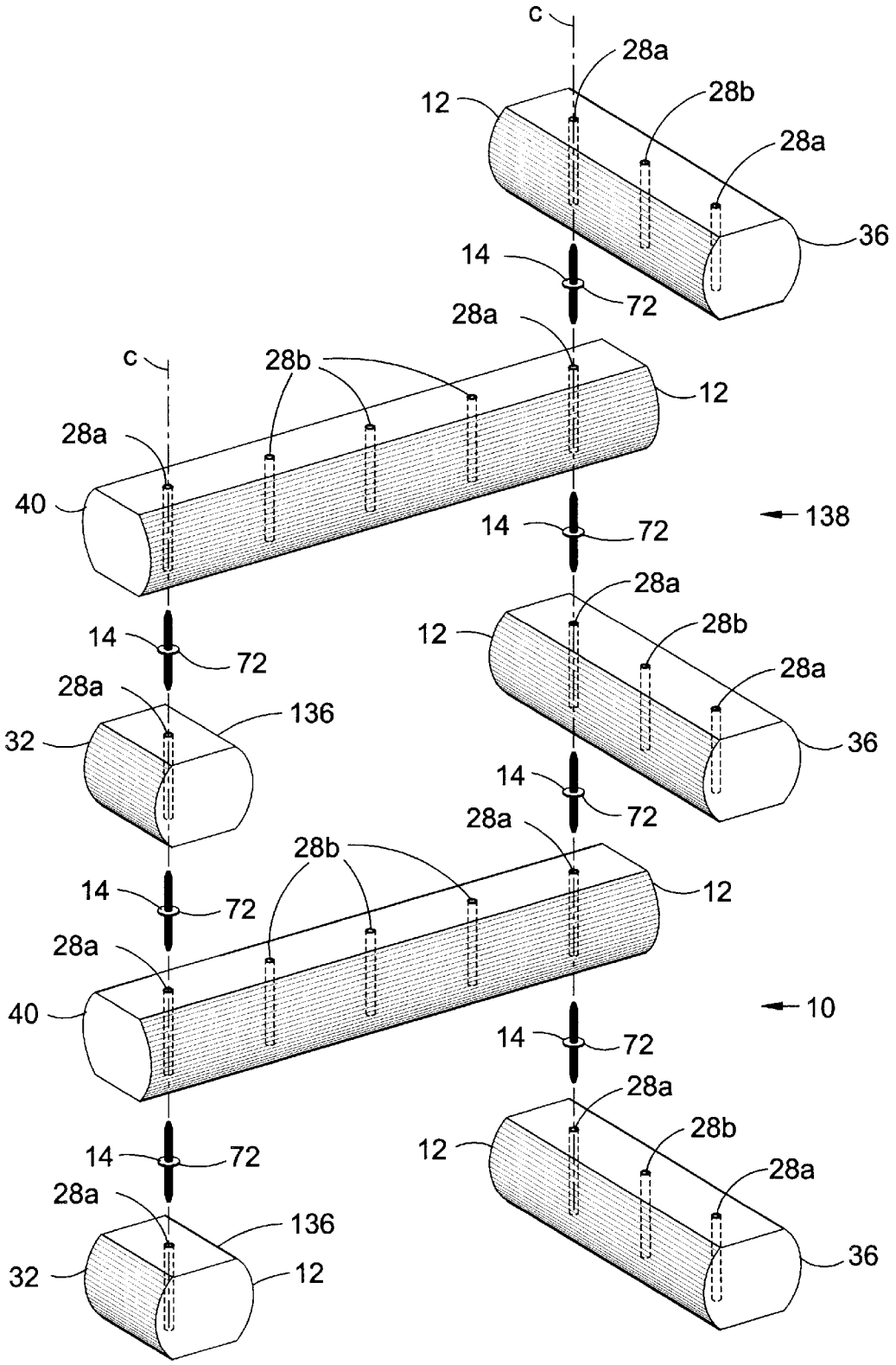
FIG. 4A is an exploded isometric view of several modular members and the pin connector embodiment shown in FIG. 3A illustrating the use of multiple overlapping modular members orthogonally oriented and of different module lengths presenting outwardly extending projections thereon.
Figure 5A:
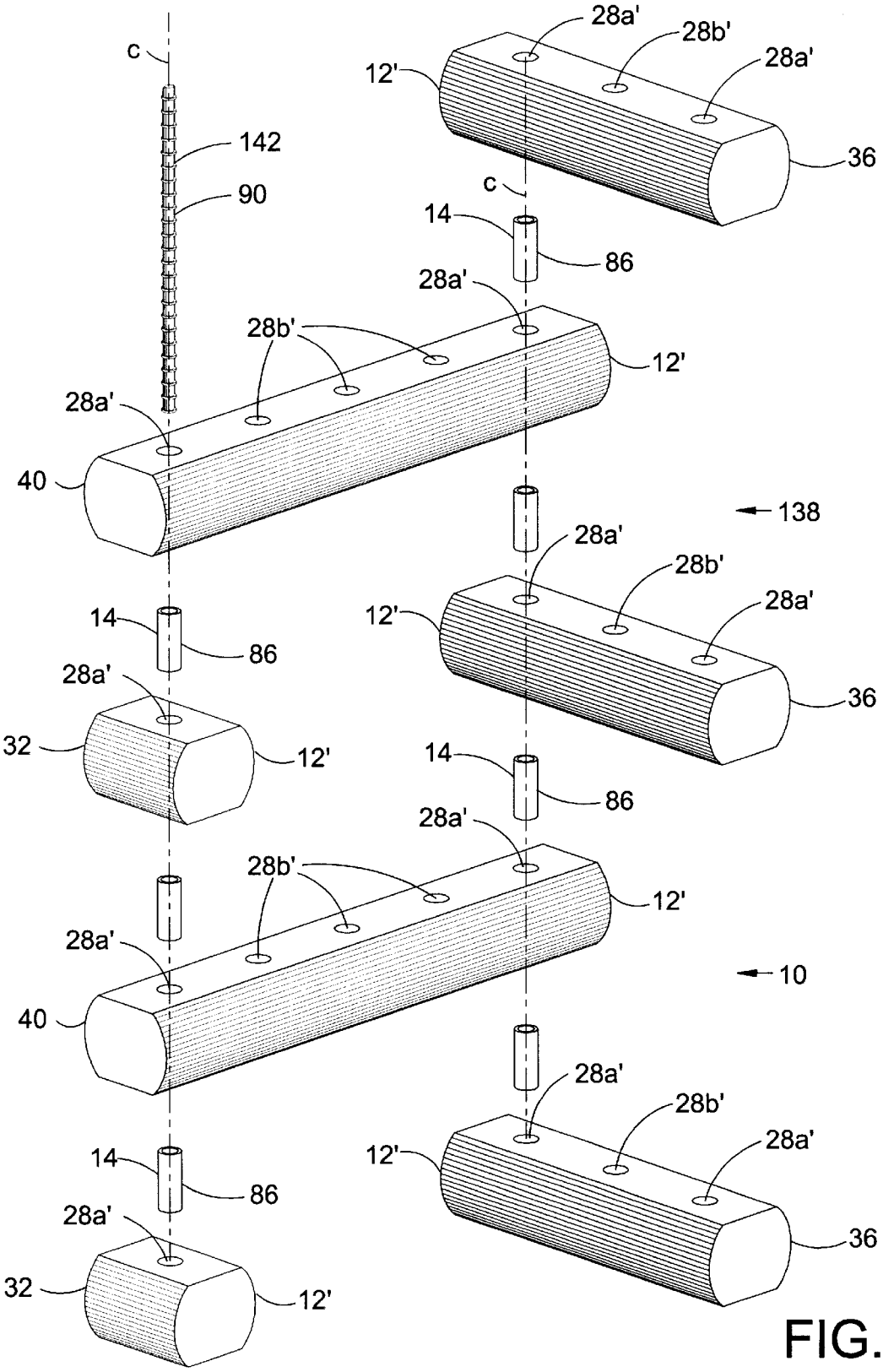
FIG. 5A is an exploded isometric view of the modular member system 10 hereof with the hole embodiment of FIG. 3B, showing the use of tubular connectors as depicted in FIG. 3B and a reinforcing bar presenting outwardly extending projections as a supplemental retainer.

The modular construction system 10 as disclosed herein further includes a method of manufacturing and assembling the modular members 12 and connectors 14 of the system 10 and structures erected using the modular construction system 10. The method of manufacturing and assembling the modular members 12 and connectors 14 may be performed in the following sequential steps:

a). Providing a plurality of elongated members with a substantially uniform and predetermined cross-sectional configuration;

b). creating a plurality of commonly configured, uniformly spaced, and longitudinally aligned holes 28 at predetermined locations in the elongated members to create an article of manufacture 30;

c). cutting at least some of the articles of manufacture 30 with perpendicular cuts 56 at points preferably about equidistance between two adjacent holes 28 as illustrated in FIGS. 2B through 2G to create a plurality of modular members 12 of various modular lengths including at least some modular members 32 with only one hole 28;

d). providing a plurality of loose fitting connectors 14 which are premanufactured in uniform lengths shorter than twice the thickness t of the modular members 12 and complementally configured to fit within holes 28; and e). interconnecting a plurality of modular members 12 with a plurality of connectors 14 in an overlapping, vertically spaced relationship to form a wall structure with at least some of the modular members 32 used as spacers between other longer modular members 34 through 52 as illustrated in FIGS. 4A and 5A to form a termination or jamb in the wall structure.

When simple pin 72 or tubular 86 connectors are used which do not have the ability to resist vertical separation, as illustrated in FIGS. 3A, 3B and 3C it is necessary to include the following two additional steps:

f). providing at least one elongated retainer 90, such as threaded rod or a plurality of shorter retainers 90 complementally configured to fit within holes 28 and mechanically engage modular members 12 within the void created by holes 28; and g). inserting the retainers 90 through a plurality of modular members 12 with vertically aligned holes 28 to enhance the structural stability and tamper resistance of the structure.

One of the preferred starting raw materials for the modular members is a naturally rot resistant species of wood in industry standard lengths of 8 or 10 feet, which have been sufficiently seasoned or kiln dried to minimize the potential for warping and twisting. However, it has been found that a conventional peeler core landscape log treated with chromated copper arsenate (CCA) is an acceptable and more economical starting raw material. This is contrary to the current teaching in the art, which directs the use of peeler core landscape logs almost exclusively to direct earth-contact applications.

Peeler cores are the by-product of a veneer lathe. The peeler cores used for landscape logs are typically 4 inches to 4.5 inches in diameter and are typically planed on two sides to produce two substantially flat, parallel surfaces approximately 2.75 inches to 3.25 inches apart. The thickness of the logs from a given manufacturer is generally fairly consistent, however, the width of the logs often varies up to ⅜ of an inch between logs or even within a single log. It is not uncommon for a log to deflect in the center during the lathe operation resulting in a greater width in the center of the log than at the ends of the log.

In typical landscaping applications, where logs are not placed parallel and adjacent to one another in a horizontal plane, this variation in width poses no problem. However, this variation in width must be taken into consideration when using peeler cores as the starting raw material for the modular members 12 of this modular construction system 10. It is preferable for the width w of modular members 12 to be substantially uniform and for the spaces between adjacent, parallel members to be fairly small and uniform. Preferably the spaces between parallel, adjacent modular members forming steps, landings, floors, tables, bench seats, etc. is about ⅛–¼ inch wide. One solution to this problem is to plane the peeler cores on all four sides instead of just two sides. The shape of the arcuate sides is desirable from a safety and aesthetic standpoint, however, if the logs are planed on all four sides it is possible to achieve an even more preferred configuration, as shown in FIG. 1A, in which the radius of the arcuate sides is greater and the gaps resulting gaps between adjacent top surfaces 16 is smaller.

Preferably, the uniformly spaced and longitudinally aligned holes 28 would be made by placing the full length starting raw material in a jig and boring at least some of the holes simultaneously with a multiple-hole boring machine. More preferably, particularly when the starting raw material for the modular members 12 is not always straight, the jig should be capable of not only securing the starting raw material, but also containing a means for temporarily straightening the raw material to permit the holes 28 to be simultaneously bored through the longitudinal axis A and perpendicular to the flat upper and lower surfaces 16, 18.

One of the principle advantages of this modular construction system 10 is that all of the modular members 12 may be easily fabricated by an end user from the single article full length modular member 30 as illustrated in FIG. 2B through 2G. Thus it is possible for a manufacturer to bundle, palletize, and transport this single article full length modular member 30 in the conventional manner for lumber products without any special packaging. The fact that these single articles full length modular member 30 may be stored in bundled, full size lengths also minimizes the potential for twisting and warping or the requirement for kiln drying, which might be necessary for other systems which must be fabricated in different lengths because of complex end configurations. Although the starting full length modular member 30 may be cut into any desired length of modular members 12 with any number of holes 28, it should be noted that limiting the designs of structures to those containing primarily modular members 12 with only odd numbers of holes 28 results in a system 10 which is more easily managed and with greater interchangeably of modular members 12 between various structures. Thus for simplicity, only modular members 32 through 52 which contain an odd number of holes are illustrated in FIGS. 2B through 2G.

When building a concatenated structure with the modular construction system 10 herein it is desirable for the builder to set aside any full length modular members 30 needed for use in the planned structure, then make the cuts 56 necessary for the longer length segments 34, 38, 42, 46, 50 and 52 before cutting the shorter length segments 32, 26, 40, 44, and 48. Often the user will be able to employ shorter length segments inherently produced from cutting the longer length segments. Many structures, particularly playhouses which include door and window openings require a number of single-hole modular member segments 32. The builder will find that waiting to produce these single-hole modular members until the end of the cutting step will often reduce the number of surplus modular members 12.

Referring now again to the drawings, the method of interconnecting a multiplicity of modular members 12 to form a concatenated structure is illustrated in FIGS. 4A through 9C.

Figure 4B:
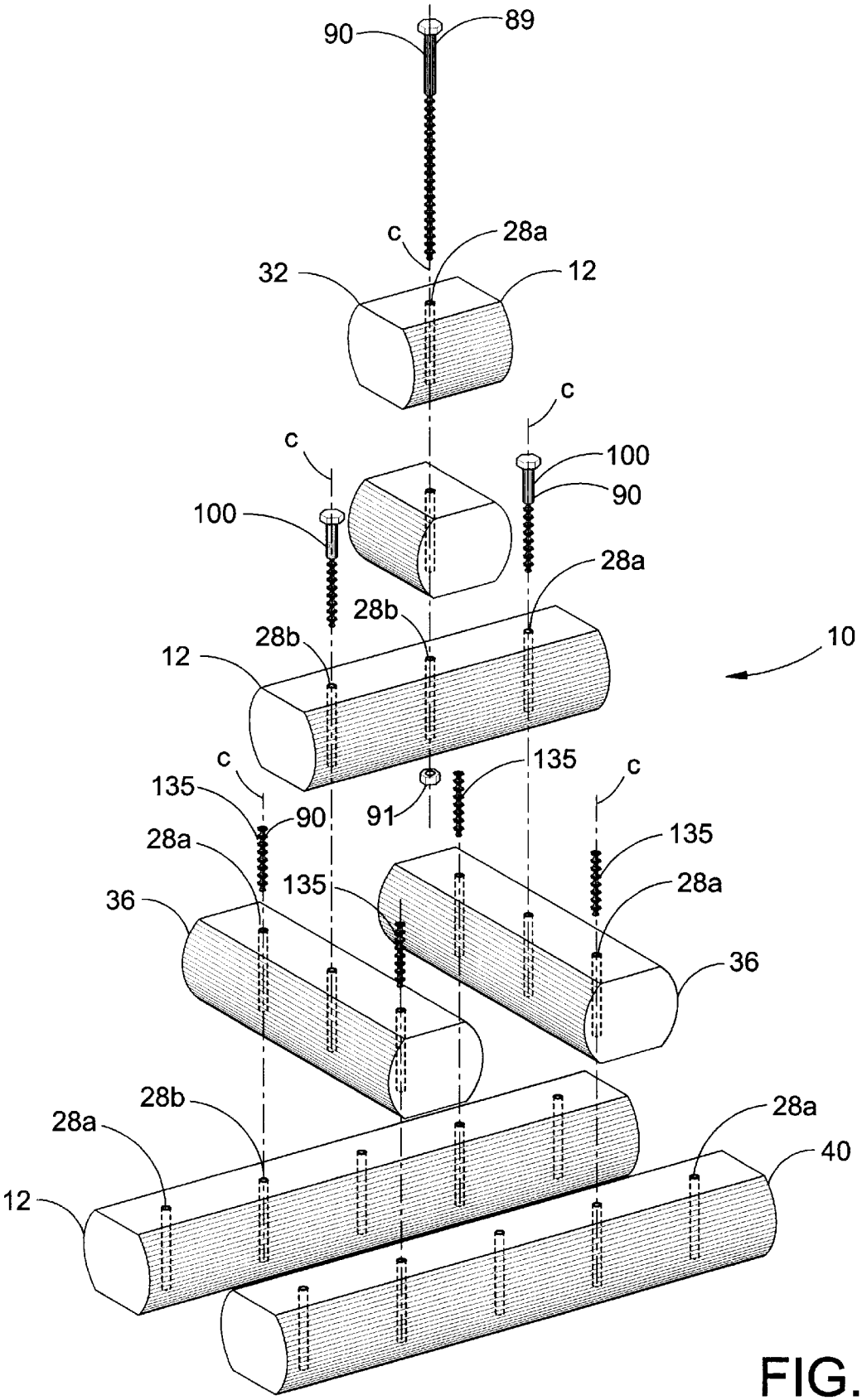
FIG. 4B is an exploded isometric view showing the interconnection of multiple layers of modular members of various lengths for placement on top of a structure to form a hip roof using several examples of threaded connectors to prevent undesired separation.

FIGS. 4A and 4B are exploded isometric views of the system 10 herein where a multiplicity of modular members 12 with hole embodiment 28 are interconnected with a plurality of connectors 14, and more specifically, pin connectors 72.

FIG. 4A illustrates how a plurality of modular members 12 may be interconnected in an overlapping, vertically spaced relationship to form a wall 138. It should be noted that single hole modular members 32 are used as spacers 136 at each end of this wall 138 to terminate the wall 138. The use of these single hole modular members 32 thus permits the construction of jambs for door openings 178 or window openings 180 as illustrated in playhouses 160, 217 and 280.

FIG. 4B illustrates how a plurality of modular members 12 with hole embodiment 28 may be interconnected in an alternating, overlapping, vertically spaced and horizontally offset relationship to form a sloping element such as a roof. FIG. 4B illustrates the provision of modular member segments 40 having 5 holes 28 as the underlying layer. Interconnected thereto in overlying, perpendicular relationship are modular member segments 36 having 3 holes 28. Pins complementally sized with the holes 28 and presenting helical threads act as threaded connectors such as screws 135, which are inserted through holes 28*a* of modular member segments 36 and into holes 28*b* of modular member segments 40 to engage the body of the modular member surrounding the holes. A further overlying modular member segment 36 having 3 holes is then secured to the holes 28*b* of the respectively underlying segments 36 by lag screws 100. In turn, two overlying segments 32 are connected through their single holes 28*a* to hole 28*b* of segment 36 by a single bolt 89 and nut 91. It may thus be appreciated that the system hereof, using holes 28 of a conventional ⅜ inch diameter, may receive a variety of different threaded fasteners as connectors 14.

Figure 5B:
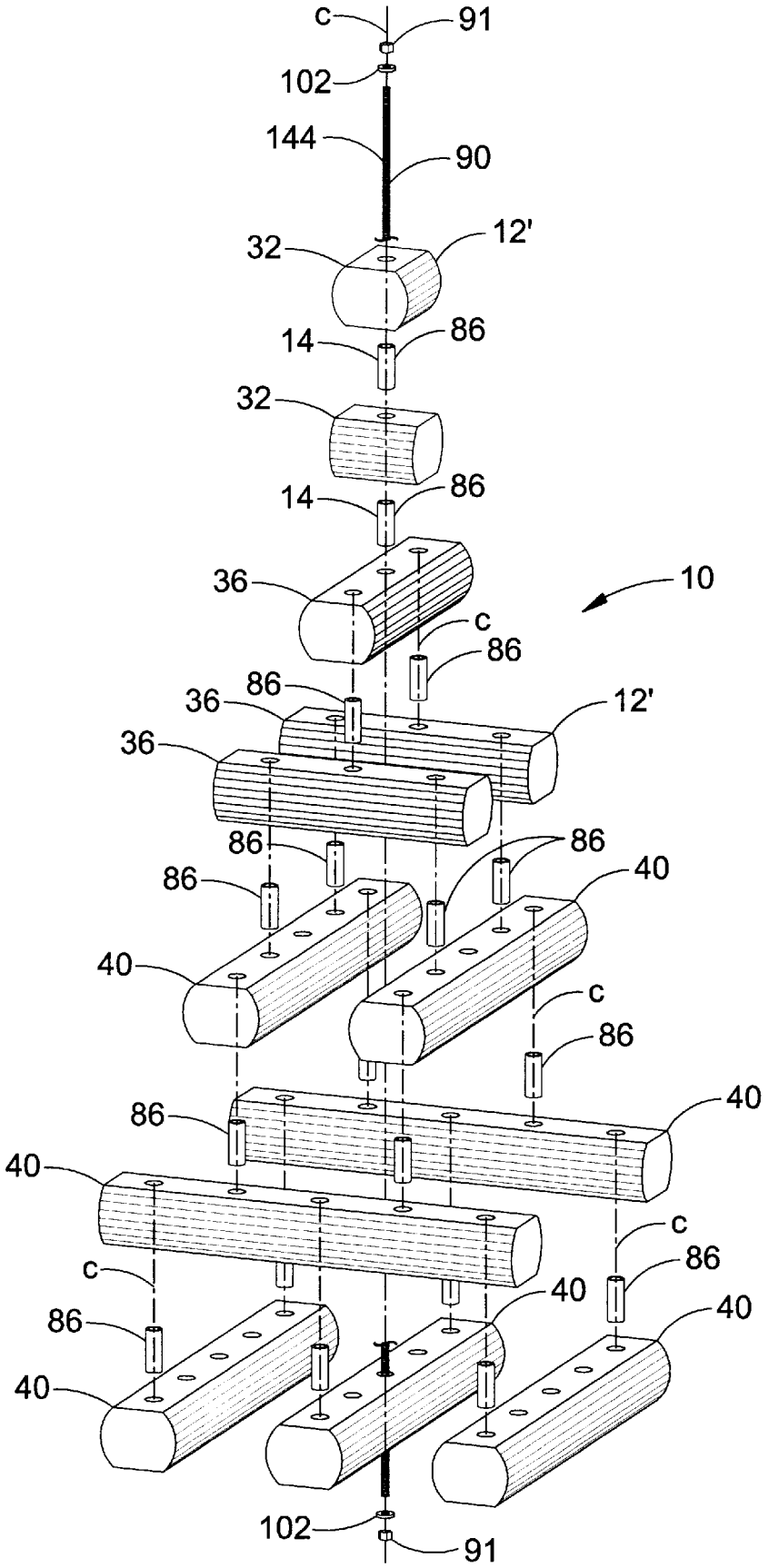
FIG. 5B is an exploded isometric view of the modular member system hereof with the hole embodiment of FIG. 3B, showing the use of tubular connectors as depicted in FIG. 3B to form a hip roof, and also illustrating the use of a threaded rod with associated washers and nuts as a single elongated retainer for securing an entire assembly of modular members.

FIG. 5A and 5B are exploded isometric views which illustrate the system 10 herein in which the modular members 12 have hole embodiment 28' and a multiplicity of modular members 12 are interconnected with a plurality of connectors 86. One of the advantages of this embodiment is that, typically, the entire structure may be initially assembled very quickly, without any tools, using connectors 86. The structure may then be subsequently supplemented with a variety of retainers 90 to enhance it's structural stability and make it tamper resistant.

FIG. 5A illustrates how a plurality of modular members 12 interconnected in an overlapping, vertically spaced relationship to form a wall or fence 138 may be subsequently reinforced and mechanically secured by driving an elongated retainer 90 through the holes 28' and the central axial opening 87 of the connectors 86. One of the preferred embodiments of a retainer 90 is a segment of conventional reinforcing rod 142. Reinforcing rod 142 is readily available, inexpensive, and presents a series of annular radially extending projections which can engage the smaller diameter inner bore 84 of hole 28'.

FIG. 5B illustrates how a plurality of modular members 12, interconnected in an alternating, overlapping, vertically spaced and horizontally offset relationship to form a hip roof structure 140 may be subsequently mechanically secured with a single elongated retainer 90. A single threaded rod 144 with associated washers 102 and lock nuts 91 on each end is illustrated in two parts for clarity as a preferred embodiment in FIG. 5B. Preferably the threaded rod 144 is cut to a suitable length and the washers 102 and lock nuts 91 are sized to permit the washers 102, lock nuts 91, and ends of the threaded rod 144 to be recessed within the enlarged upper and lower bores 80,82 of hole 28'.

Figure 6A:
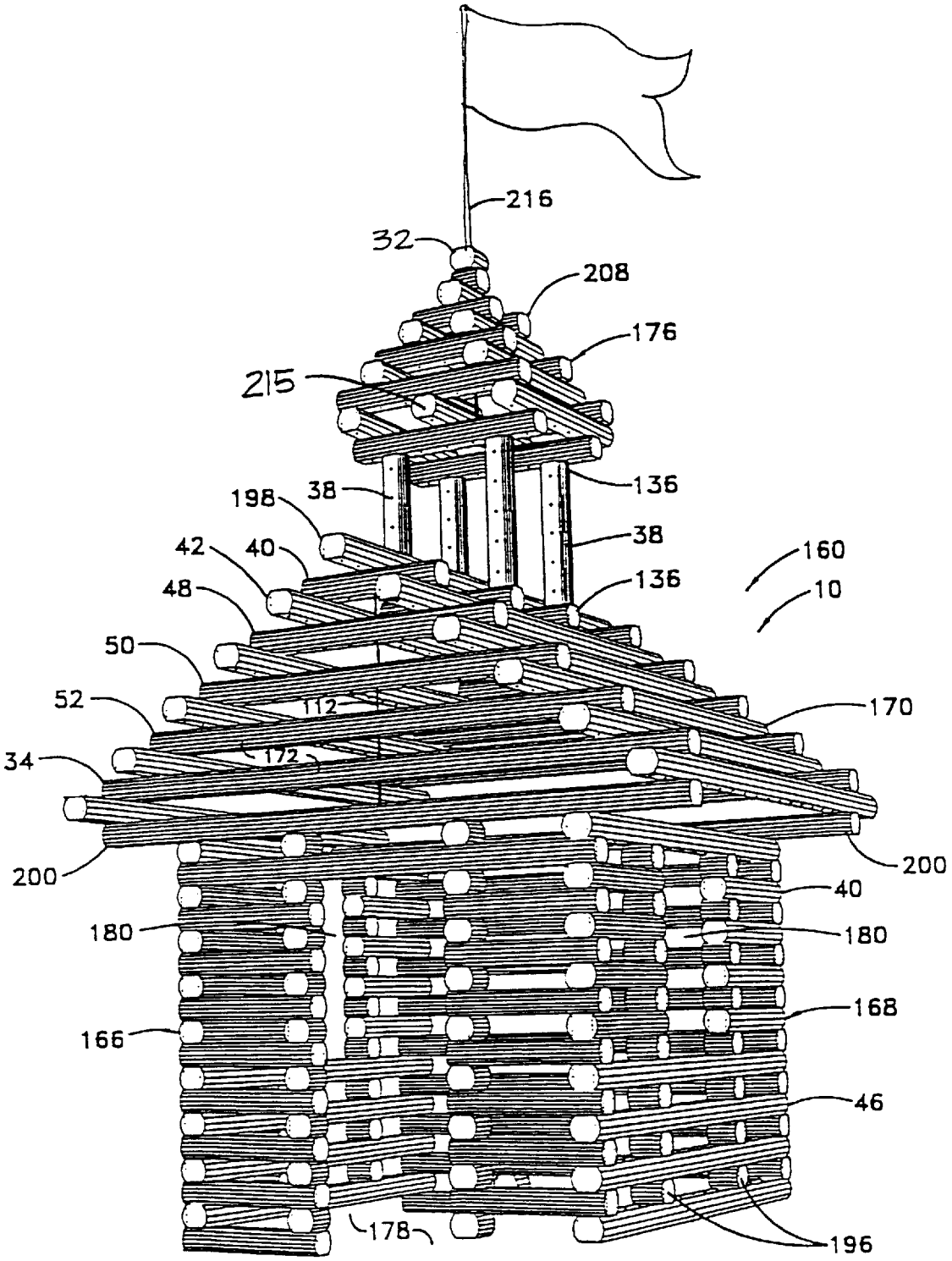
FIG. 6A is a perspective view of an exemplary one-story, single room playhouse with a gable roof structure and cupola constructed by interconnecting a plurality of modules of various lengths in accordance with the present invention.
Figure 6B:
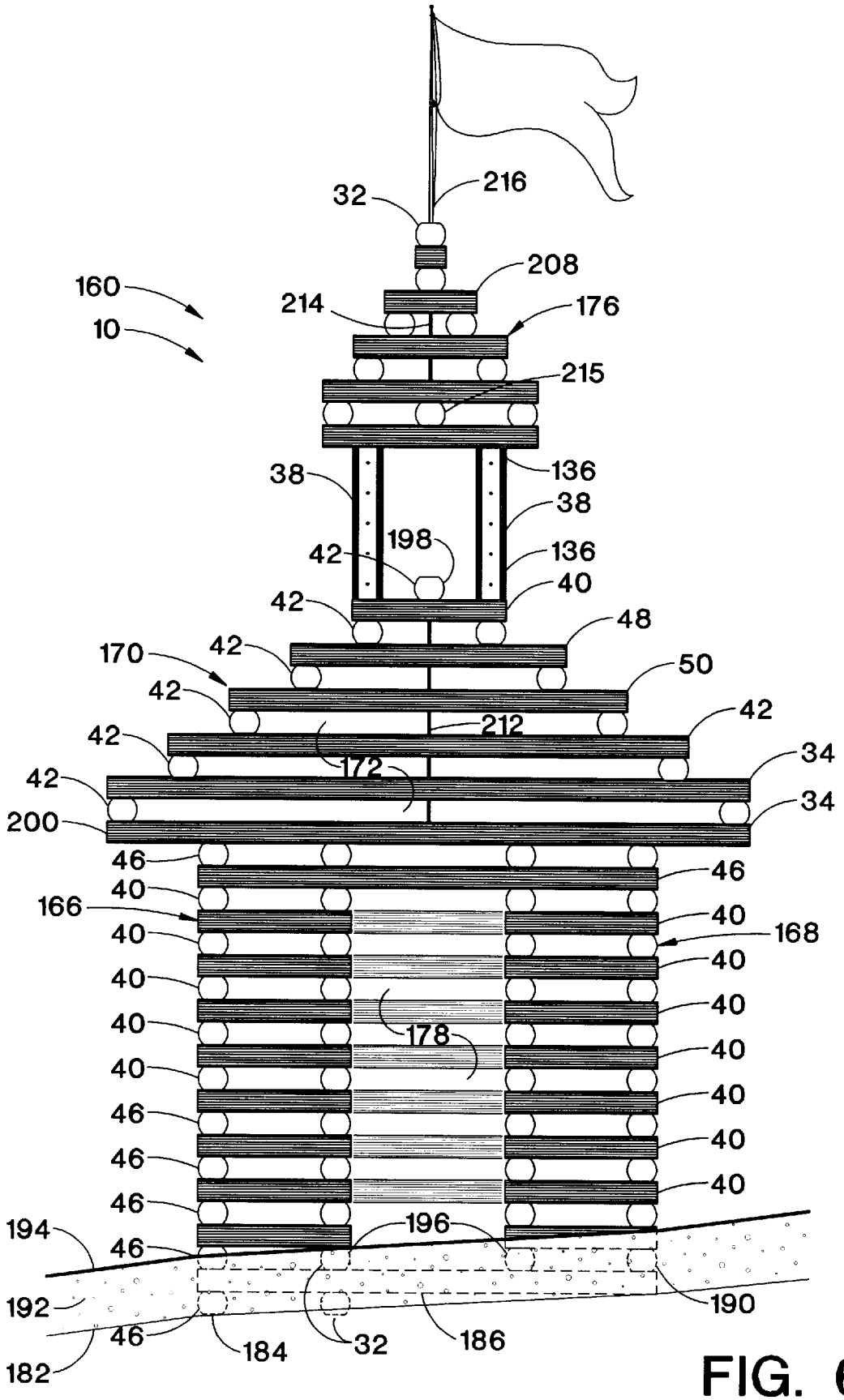
FIG. 6B is a front elevational view thereof showing the grade and below-grade foundation.
Figure 6C:
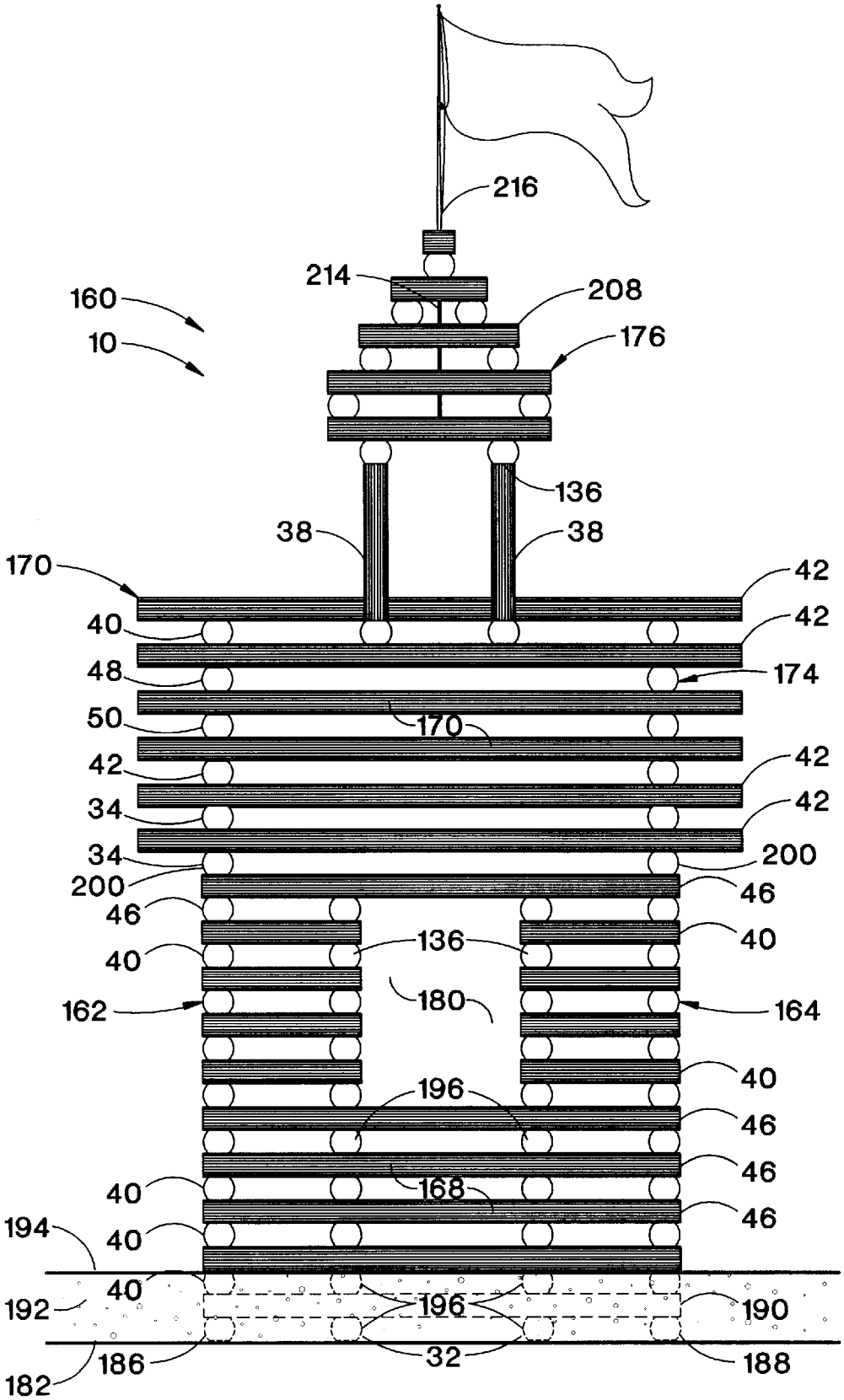
FIG. 6C is a side elevational view thereof showing the grade and below-grade foundation.

FIGS. 6A, 6B and 6C illustrate a simple playhouse 160 which is typical of the type of above grade structures which can be readily fabricated using the system 10 hereof. Playhouse 160 is described herein in a scale for children's use, but could be built with larger dimensions for adult occupancy or storage. Playhouse 160 is constructed of modular members 12' with hole embodiment 28' and connectors 86, supplemented with lag screws 136 and elongated mechanical connectors 212, 214. Playhouse 160 has a front wall 162, a rear wall 164, two side walls 166,168, a gable roof 170, two gable ends 172, 174 and a cupola 176.

Playhouse 160 also has a door opening 178 in front wall 162 which is approximately 22 inches or 5 b wide by 47 inches or 16 t high and two window openings 180, which are approximately 22 inches or 5 b wide and 26 inches or 9 t high. It may be understood that the size of these door and window openings 178,180 are scaled down for small children. It may also be understood that it is a advantage of this modular construction system 10, that these door and window openings 178,180 may be enlarged by increments of b in width and increments of t in height as the children mature.

It is not essential to have an absolutely level surface to build a structure with this modular construction system 10, nor is it necessary to construct a separate masonry or concrete foundation. It is necessary, however, to establish an initial level foundation course of modular members 12. For inhabitable structures it is preferable to provide a foundation course around the entire perimeter of the structure, including under the door openings, to minimize the potential for differential settlement. When constructing playhouses, it is preferable to add additional foundational layers of modular members 12 to raise the structure and permit the addition of an impact absorbing material such as wood mulch or pea gravel.

As illustrated in FIGS. 6A, 6B and 6C, the original grade level 182 was inclined and unlevel. An additional modular member 184 was added on the left side 166 of the structure 160 and additional foundation courses 186, 188 and 190 were added to raise the structure 160 and permit the installation of an impact absorbing material 192 with a higher finish grade level 194.

The walls 162, 164, 166 and 168 include lintels and jambs for door and window openings 178,180 which are constructed as illustrated in FIG. 5A with jamb spacers 136. Additional single hole modular members 32 have been inserted as spacers 196 between modular members 12 forming walls 162, 164, 166 and 168 below the modular members 12 of the walls defining the jambs of door and window openings 178,180 so that the weight of the overlying structure is more evenly distributed and carried by more than one modular member 12. The modular members 12 constituting the lintels 46 are also supported by intermediate single hole modular members 32.

The gable roof 170 of playhouse 160 is formed by stacking alternate courses of modular members 12 of the same length and parallel with the roof ridge 198, intercalated with modular members of selective incrementally progressively decreasing length in the direction perpendicular to the ridge 198. The amount of the decreasing length will typically be an even number multiple of the hole spacing b except when a half space connector 92 is used. The modular members 12 which are parallel to the ridge 198 and which appear to form the roof shape are connected to the modular members 12 which form the gable ends 172,174 of the structure in the third hole 28*b* from the respective ends 20, 22 to create the appearance of an overhang. The first modular members 200 of the gable ends 172,174 are of a length greater than the modular members 12 used in the walls 162,164 below and cantilever beyond the exterior walls perpendicular thereto to create an overhang beyond the side walls 166,168 of the playhouse 160.

The gable roof 170 and gable ends 172,174 are tied together with retainers 90 which are preferably elongated threaded rods 212 which are inserted vertically through the center holes 28*b* of the modular members 12 forming the gable ends 172,174 from the top of the ridge 198 to the bottom of the first modular member 200 of the gable ends.

Playhouse 160 also has a cupola 176 which is constructed by placing four modular members 38 in a vertical orientation and a small hip roof portion 208. The modular members 206 are secured with lag screws to the gable roof 170 below and the small hip roof portion 208 above. These vertical members 38 may also be provided with additional bracing such as gussets or the like (not shown) to resist lateral movement. The small hip roof portion 208 of the cupola 176 is constructed as described in FIG. 5B and is tied together with a retainer 90 such as a single elongated threaded rod 214 intercoupling a tie member 215 and the member 32 at the peak of the structure. A flagpole with flag 216 is shown inserted in the upper bore 82 of the uppermost modular member 32.

Figure 7B:
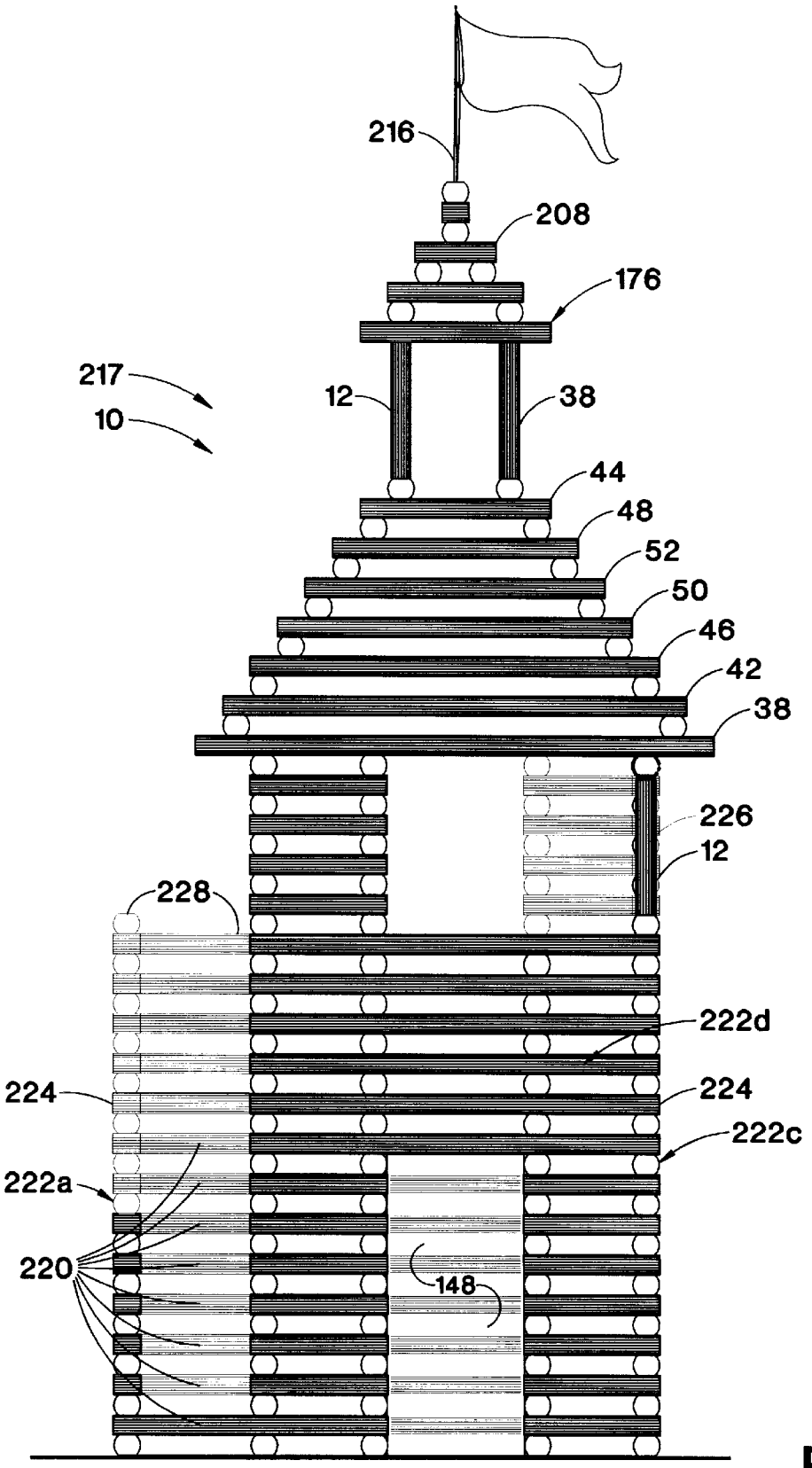
FIG. 7B is a front elevational view thereof.
Figure 7C:
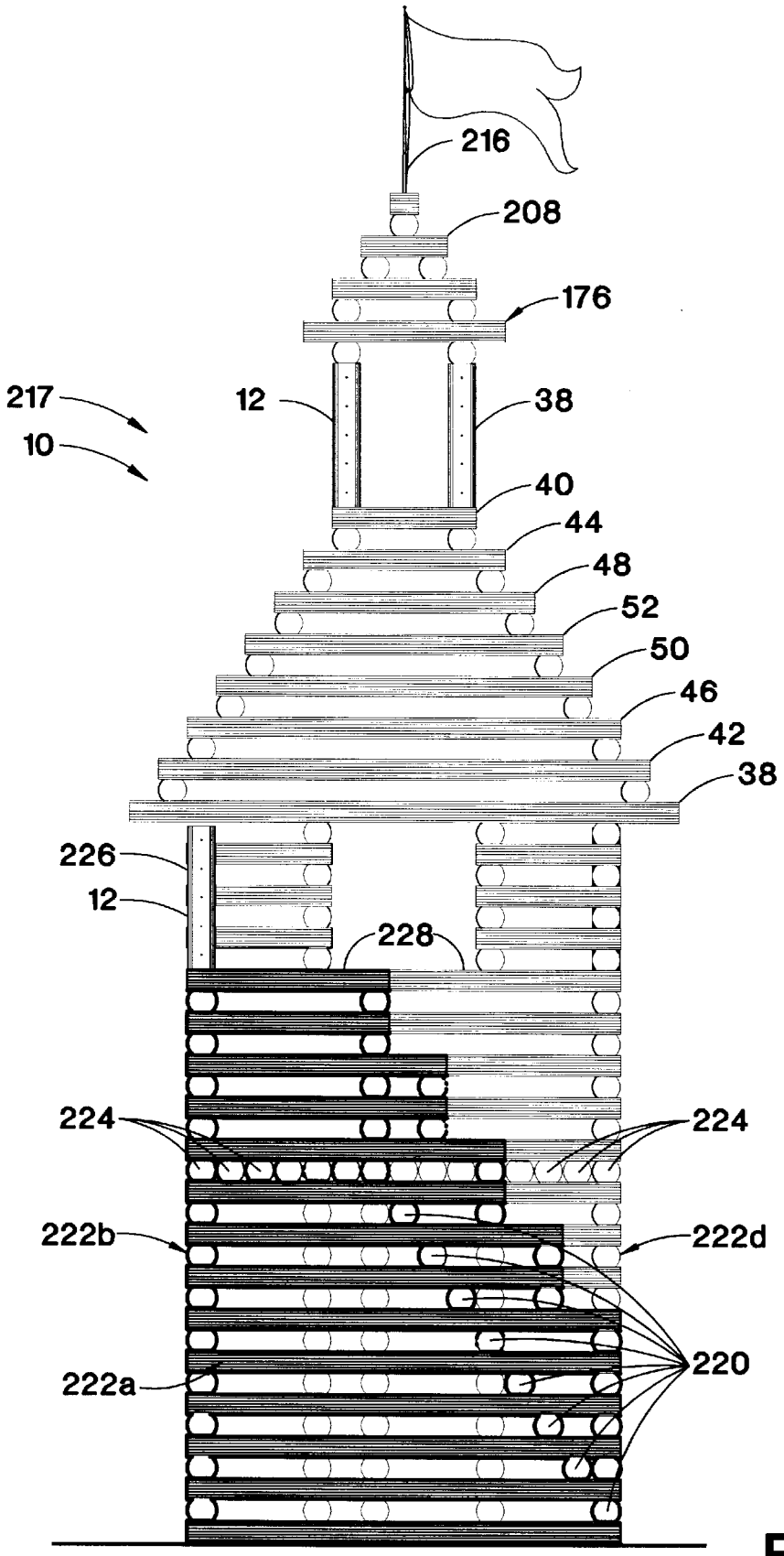
FIG. 7C is a side elevational view thereof.

FIGS. 7A, 7B and 7C show an expanded playhouse 217 of the system 10 hereof which may be constructed from materials previously used, for example, in playhouse 160. Expanded playhouse 217 includes stairs 220 and an upper floor 224 to provide two superposed levels of use. If modular members 12 in full length members or segments of the desired lengths are not already available from previous construction, the full length modular members 30 may be cut to the desired segment length and used in walls 222*a*, 222*b*, 222*c* and 222*d*, upper floors 224, stairs 220, roof supports 32, posts 226 and railings 228, and in cupola 176.

The stairs 220 in expanded playhouse 217 are formed by interspersing additional horizontally oriented modular members 12 in a common parallel orientation, and vertically spaced and horizontally offset displacement between and perpendicular to two horizontally offset parallel wall structures 244 and 246. The upper floor 224 is formed by laying a series of modular members 12 adjacent and parallel to one another in the same horizontal plane, with the spacing between longitudinal axes of the adjacent modular members 12 equal to and determined by the spacing of the holes 28 in the modular members forming the walls perpendicular to and supporting the modules forming the upper floor 224. The hip roof shown in FIGS. 7A, 7B and 7C is formed by alternately interconnecting and stacking modular members in an overlapping, horizontally spaced relationship in which courses of opposed horizontally co-planar modules are vertically spaced, each successive course of parallel modules in both relatively orthogonally transverse orientations are incrementally shorter and horizontally offset. In this exemplary structure the slope of the roof is equal to 2 t/b, since the modular members are offset a distance of b with each successive course. It should be noted that as previously disclosed in the description of FIG. 3C that slopes of t/b, 1.33 t/b, and 4 t/b are also possible with this modular construction system.

It may be understood that the superimposed weight of overlying modules serves to secure many of the courses or layers of modular members 12 against undesired vertical or horizontal displacement, warping and twisting. However, additional securement may be necessary to inhibit lateral or vertical movement between modular members 12 in certain applications or in the uppermost modular members 12. This may be accomplished with a variety of mechanical retainers 90 used in conjunction with connectors 14 such as connectors 72, 86 or 92 as illustrated in FIGS. 3b, 3C, 4B, 5A and 5B or by using a plurality of connectors 14 such as connector 104 which includes a means of preventing undesired vertical separation. Additional examples of a retainer 90 and connector 14 with retaining means are shown in FIGS. 8A and 8B.

Figure 8A:
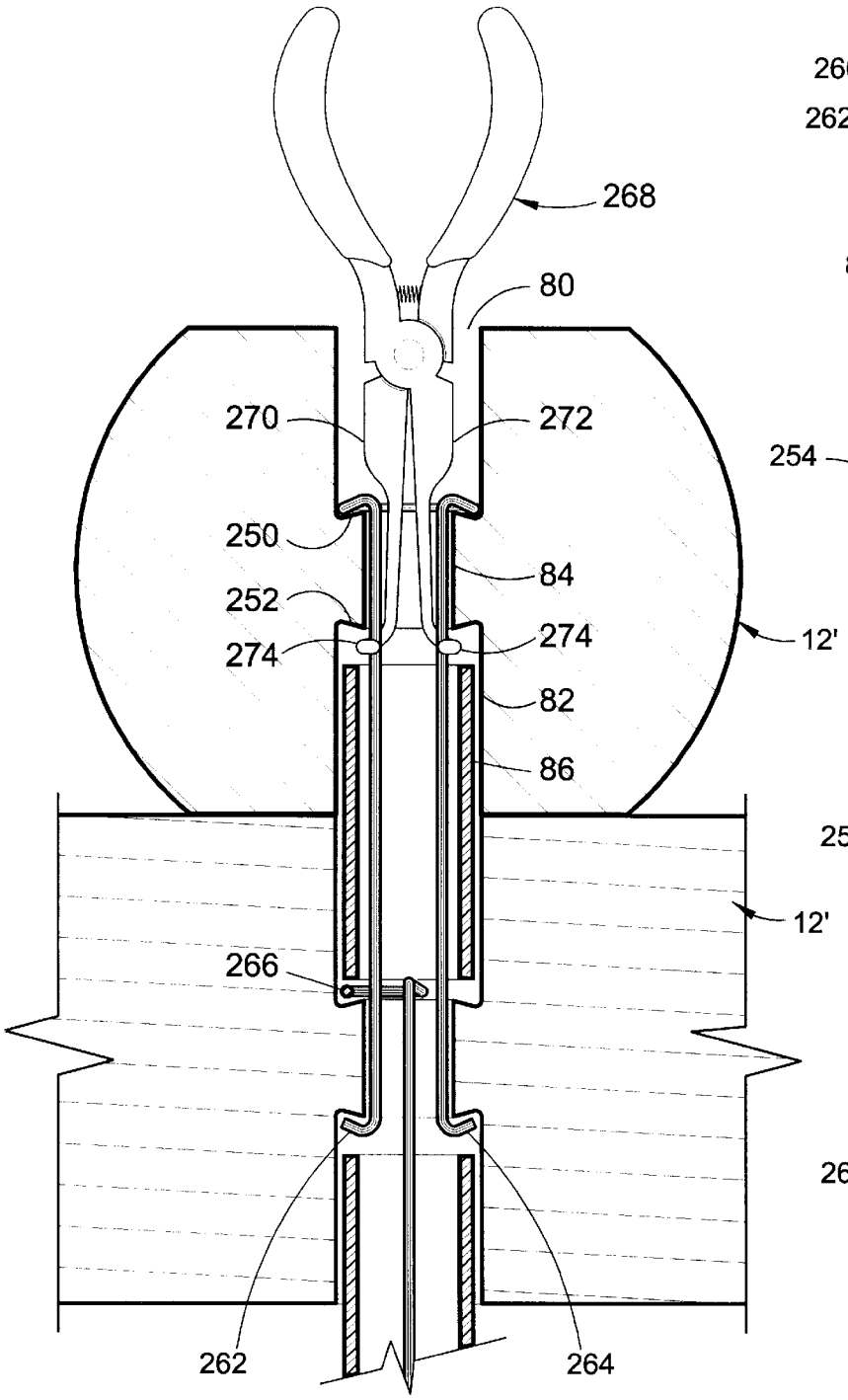
FIG. 8A is a partial cross sectional view of two modular members taken through aligned holes of adjacent members showing the use of a spring-wire retainer inserted through a tubular connector and a tool for compressing the legs of the retainer for insertion and withdrawal.

In the embodiment shown in FIG. 8A, tubular connector 86 is provided and shown inserted into the respective lower bore 82 and upper bore 80 of the overlying, relatively perpendicularly lined modular members 12'. The preferred diameter of upper bore 80 and lower bore 82 shown in FIG. 8A would be about ⅞", while the preferred diameter of intermediate bore 84 would be about ½". Advantageously, the bottom 250 surface of upper bore 80 and the bottom surface 252 of bottom bore 82 are cut more deeply adjacent the side wall of the bore and beveled inwardly to present a frustoconical surface configuration in the nature of a reverse countersink configuration wherein the bottom surfaces slope away from the intermediate bore 84.

Figure 8C:
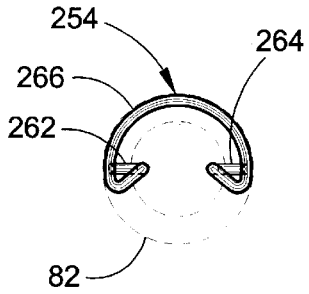
FIG. 8C is a top plan view of the retainer of FIG. 8A, with the bore within which the corresponding connector is received being shown in phantom.
Figure 8B:
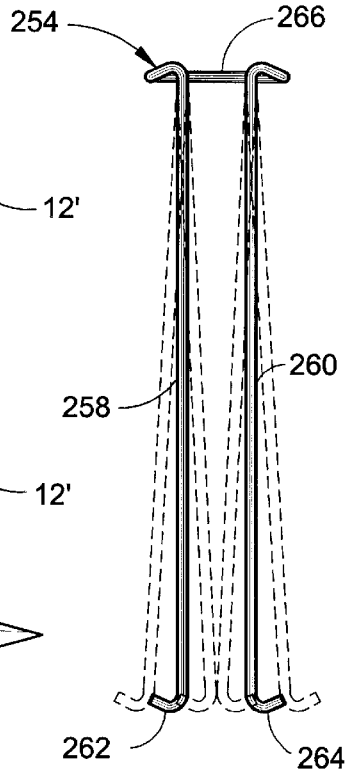
FIG. 8B is a side elevational view of the retainer shown in FIG. 8A, with the unconstrained, and compressed positions of the retainer legs shown in phantom.

A retainer 254, preferably of stainless steel spring wire is provided for insertion through the central opening 87 of tubular connector 86. The retainer is preferably unitary and includes a pair of legs 258 and 260 which are normally biased in a diverging relationship, as shown in FIG. 8B each of the legs 258,260 including a respective hook 262 and 264. The legs 258,260 are interconnected adjacent their upper ends opposite hooks 262,264 by bight 266 which is preferably arcuate and semicircular in configuration as shown in FIG. 8C and cooperatively sized for receipt in the bottom surface 250 of upper bore 80 when inserted into position as shown in FIG. 8A. Similarly, hooks 262,264 are sized for receipt in bottom bore 82 and for engagement therewith.

As shown in FIG. 8A, by orienting successive overlying retainers 254 perpendicularly to one another in superposed relationship a plurality of adjacent modules 12' may be interconnected and retained against undesired vertical separation. A tool 268 is provided for insertion and removal of the retainer 254 and includes jaws 270 and 272 each presenting a laterally displaced tooth 274 at the nose end thereof for compressing the legs 198,200 to retract hooks 262,264 for passage through intermediate bore 84 when the tool 268 is withdrawn upperwardly.

FIG. 8B is a partial cross-sectional view of two modular members taken through aligned holes of adjacent members showing the use of a connector similar to connector 104 depicted in FIG. 3D, but adapted for use with hole embodiment 28'. This connector 275 is configured to include retaining means suitable for engagement within the enlarged bores 80 and 82 of hole 28'.

Figure 8F:
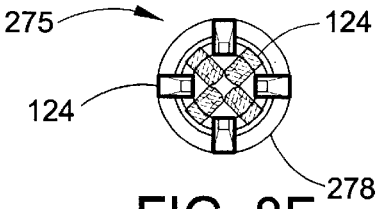
FIG. 8F is a top plan view of the connector and sleeve shown in FIG. 8D.
Figure 8D:
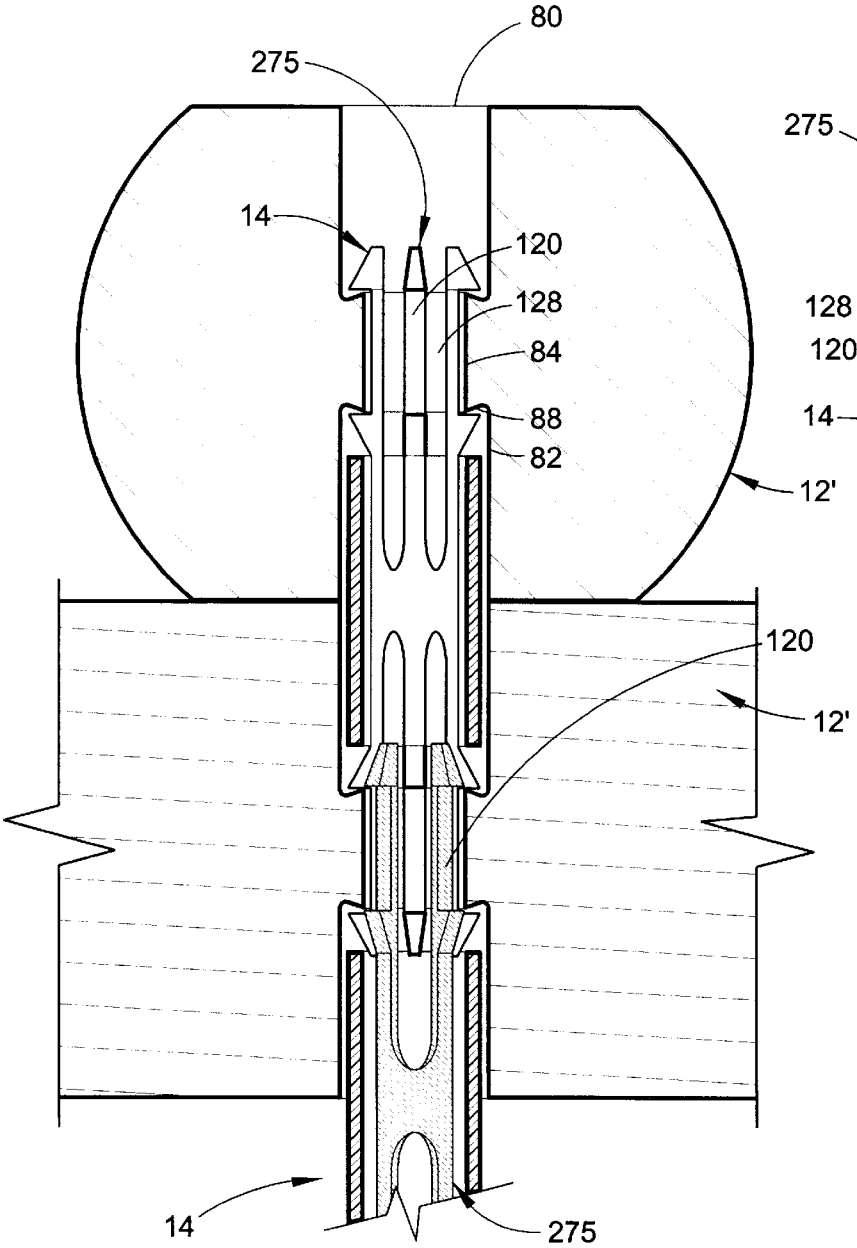
FIG. 8D is a partial cross-sectional view of two modular members taken through aligned holes of adjacent members showing the use of a connector similar to the connector depicted in FIG. 3D, with resilient legs and barbed ends, but including an axially shiftable sleeve to inwardly depress the fingers and adapt the connector for use with the hole embodiment of FIG. 3B.

Connector 275 is preferably molded of a resilient synthetic material and presents a plurality of flexible fingers 120. Each of the flexible fingers 120 includes a stretch 122 which is longer than the sum of the depths of bores 80 and 84 whereby an engagement barb 124 may pass through the narrow interconnecting bore 84 and be received within enlarged bores 80, 82. The fingers 120 are preferably presented in a circular array with an axial central opening 126 therebetween. A slot 128 is presented between adjacent fingers 120 to permit individual flexibility of the fingers 120 and, in combination with the central opening 126, enable the fingers 120 to be deflected inwardly toward the opening 126 in unison. The width of the slots 128 must be greater than the width of flexible fingers 120 to permit the ends of a subsequent connector 275 to intercalate therewith when rotated at a 45 degree angle and interconnecting subsequent adjacent modular member through axially aligned holes, and thus to overlap the ends of the previous connector 275. It may be seen from FIG. 8B that each of the flexible fingers 120 include a barb 124 on the end with a beveled surface 130 oriented at an angle to the sides of the bores 80,82 when inserted therein, and a face 132 which lockingly engages with the shoulders 88 of hole 28'. It is preferable for the ends of the barbs 124 to also be beveled or chamfered on the sides to facilitate the insertion of subsequent overlapping connectors 275 as shown in FIG. 8F. Each flexible finger also includes a similarly configured inclined surface 276 with a beveled surface 130 and face 132 which lockingly engages with the shoulders 88 on the opposite side of interconnecting bore 84.

Figure 8E:
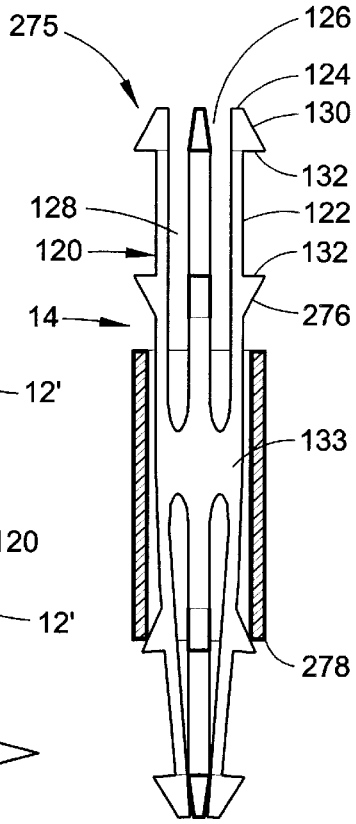
FIG. 8E is a side elevational view of the connector shown in FIG. 8D

Connector 275 also includes a centrally located waist 133 and a tubular segment 278 surrounding the waist as shown in FIG. 8E. Preferably the outside diameter of the waist is slightly smaller than the diameter of the smaller interconnecting bore 84 and the outside diameter of the tubular segment 278 is slightly smaller than the diameter of enlarged bores 80,82. The inside diameter of the tubular segment 278 is larger than the outside diameter of the waist 133 permitting it to freely slide longitudinally against the inclined surfaces 276 thereby deflecting the flexible fingers 120 in unison toward the central opening 126 and permitting the removal of the connector.

FIGS. 9A and 9B illustrate an exemplary two story barn playhouse 280 constructed of interconnected modular members 12 with hole configuration 28' of the modular construction system 10 hereof. This playhouse illustrates the use of connector 92 as shown in FIG. 3C to create a steeper roof 282 with a slope of 4 t/b. It also includes an interior stair 284 to the second floor level and an alternative cupola 286 without any modular members 12 in a vertical orientation.

The first floor portion of the barn playhouse 280 is constructed in a manner similar to playhouses 160 and 217. It may be seen from counting the ends 20 of the modular members 12 forming the second floor 288 that the width of the front wall 290 of the first floor level of barn playhouse is 19 b and that there are two modular members 292,294 which are perpendicular to the modular members 12 forming the second floor 288 of the barn playhouse 280 and lying horizontally directly above the front wall 290 of the first floor level, It may also be seen that these two modular members 292,294 cantilever a distance of 2 b beyond the sides of the barn playhouse 280. Since the full length modular member 30 for this embodiment was only 22 b in length, it is necessary to place the two modular members 292,294 in abutment to create an effective combined length equal to 23 b. Thus, the ends 20,22 are most preferably planar.

The roof of this barn playhouse 280 has three portions, each of which have a different slope. The lower portion of the roof 296 has a slope of 2 t/b and is formed using connectors 86 and horizontally offsetting parallel, vertically-spaced modular members 34 a distance of b with each successive course. The intermediate portion of the roof 298 has a slope of 4 t/b and is formed using connectors 92 and horizontally offsetting parallel, vertically-spaced modular members 34 a distance of 0.5 b with each successive course. The upper portion of the roof 300 has a slope of t/b and is formed using connectors 86 and horizontally offsetting pairs of parallel, vertically-spaced modular members 34 a distance of 2 b with each successive course.

It should be noted that it is preferable, when constructing playhouses with roof slopes of t/b, to use pairs of parallel, adjacent modular members 12 as illustrated in FIGS. 9A and 9B in lieu of single modular members 12 as shown in playhouse 160. When pairs of parallel, adjacent modular members 12 are used the resulting distance between the bodies 15 of the pairs of modular members 12 of two successive courses is of a size which would inhibit entrapment of a child.

The upper portion of the roof 300 of playhouse 280 is tied together at each end with retainer 92 in the form of an elongated mechanical connector, preferably a threaded rod 212 with washers 102 and lock nuts 91 extending from the upper bore 80 of a hole **28*b* in the ridge 198 to the lower bore 82 of a hole 28*b* in modular member 302. Preferably the elongated connector 212 and any associated hardware would be recessed into the upper and lower bores 80,82. The cupola 286 is secured to the barn playhouse 280 in a similar manner with a single elongated mechanical connector from the top bore 80 of the uppermost module 32 to the bottom bore 82 of the ridge 198 which serves as a tie bar. Thus it may be seen that a playhouse built in accordance with this modular construction system 10** may be quickly and easily assembled without any tools and subsequently mechanically secured with a very minimal number of mechanical connectors.

Although preferred forms of the invention have been described above, it is to be recognized that such disclosure is by way of illustration only, and should not be utilized in a limiting sense in interpreting the scope of the present invention. Obvious modifications to the exemplary embodiments, as hereinabove set forth, could be readily made by those skilled in the art without departing from the spirit of the present invention.

The inventor hereby states his intent to rely on the Doctrine of Equivalents to determine and assess the reasonably fair scope of his invention as it pertains to any apparatus not materially departing from but outside the liberal scope of the invention as set out in the following claims.

What is claimed is:

1. A concatenated structure for erection on a supporting surface comprising:

a multiplicity of modular members, each having a longitudinal axis, a pair of spaced-apart ends, a width and a thickness defined by spaced-apart substantially parallel and planar upper and lower surfaces, said modular members presenting a substantially common cross-sectional configuration, wherein ones of said modular members have a single hole having a central axis oriented substantially perpendicular to said longitudinal axis and others of said modular members present a plurality of spaced-apart holes having coplanar central axes oriented substantially perpendicular to and aligned substantially along the longitudinal axis of each of said other modular members; and a plurality of connectors received in selected ones of said holes for interconnecting adjacent ones of said modular members, said multiplicity of modular members being interconnected in overlapping, alternating, vertically aligned courses to present at least four upright walls, each of said walls presenting gaps between superposed commonly oriented ones of said modular members approximately equal to the thickness of said modular members, at least some of said one modular members being alternated and interconnected with some of said other modular members to define a door opening, at least some of said one modular members being alternated and interconnected with some of said other modular members to define a window opening, at least some of said other modular members being interconnected to adjacent modular members by said connecting means.

2. The structure of claim 1, at least some of said connectors including means for inhibiting separation of interconnected modular members along the central axes of their respective selected holes in which said connectors are received.

3. The structure of claim 2, including a retainer separate from said connector and received in said respective selected holes in which said connectors are received for inhibiting separation of interconnected modular members along the central axes of said holes.

4. The structure of claim 1, wherein said supporting surface is a grade and said door opening is defined by a lintel modular member above said grade a sufficient dimension to permit passage of an ambulatory human between said grade and said lintel modular member, wherein said lintel modular member is less than five feet six inches above said grade.

5. The structure of claim 1, wherein some of said modular members are arranged in alternating courses in perpendicular relationship to present a gable roof with a plurality of said roof-defining members having a substantially constant, equal length intercalated with a plurality of successively shorter ones of said roof-defining members, wherein said constant length members extend outwardly of said successively shorter members to define an overhang.

6. The structure of claim 5, wherein the uppermost one of said constant-length members serves as a ridge member, and including a retainer inserted downwardly through one of said holes in said ridge member and through holes located approximately midway between the ends of at least some of the successively shorter ones of said roof defining members to inhibit separation of said intercalated roof-defining modular members.

7. The structure of claim 5, including a plurality of intercalated modular members positioned on said roof to present a cupola, wherein at least some of said modular members are arranged in alternating perpendicular courses of opposed horizontally oriented parallel pairs of members to present a cupola roof above said gable roof.

8. The structure of claim 7, wherein said cupola roof includes an uppermost peak member presenting a vertically oriented hole therethrough, substantially aligned with a hole of said ridge member, and a retainer passing through the holes of said ridge member and said uppermost peak member to intercouple and retain said modular members defining said cupola therebetween.

9. The structure of claim 3, wherein the holes of said ones and said others of said modular members present a first circular bore of a first diameter, a second, coaxial bore of a second diameter smaller than said first diameter, and a third circular bore coaxial with said first bore and having said first diameter, said second circular bore being located intermediate said first and third bores, wherein said connector includes a tubular member presenting an axially aligned central opening, said tubular member being complementally sized for receipt within said first and said third bore but not said second bore, and wherein said retainer includes a threaded rod configured for insertion through said central opening and said second bore and a washer and nut for coupling to said threaded rod sized for receipt within said first and said third bore.

10. The structure of claim 1, wherein at least some of said modular members are arranged and intercoupled to said modular members defining at least two opposed ones of said walls in spanning, parallel, side-by-side orientation and above said door opening to present an elevated upper floor, and at least some others of said modular members are arranged and intercoupled to said modular members defining at least one of said walls in vertically and horizontally staggered, parallel orientations to define stairs for accessing said elevated floor.

11. The structure of claim 1, wherein some of said modular members are arranged in pairs of alternating courses in perpendicular relationship to define a hip roof, including a first pair of adjacent overlapping relatively perpendicular courses of opposed parallel roof-defining members, connected to and positioned beneath a second pair of adjacent overlapping relatively perpendicular courses of opposed roof-defining members, the length of the modular members of each of said courses of said first pair being greater than the length of the modular members of the second pair which are parallel thereto, the difference in length of the modular members between the respective parallel courses of said first pair and said second pair being substantially a whole number multiple of the hole spacing.

12. The structure of claim 11, wherein said hip roof includes an uppermost peak member presenting a vertically oriented hole therethrough, a horizontally oriented elongated tie member presenting a vertically oriented hole therethrough substantially aligned with the hole of said peak member, and an elongated retainer passing through the hole of said peak member and the hole of said tie member in vertical alignment therewith to intercouple the pairs of said modular members defining said hip roof therebetween.

13. The structure of claim 11, wherein at least some of said modular members are arranged in alternating perpendicular courses of opposed horizontally oriented parallel modular members supported above said hip roof to present a cupola.

14. The structure of claim 13, wherein said cupola includes a roof having an uppermost peak member presenting a vertically oriented hole therethrough, a horizontally oriented elongated tie member presenting a vertically oriented hole therethrough substantially aligned with the hole of said cupola peak member, a plurality of intercalated modular members presenting a cupola roof therebetween, and a retainer passing through the holes of said cupola peak member and said tie member to intercouple and retain said cupola roof members therebetween.

15. The structure of claim 1, including a first plurality of adjacent modular members in a substantially common horizontal plane connected at one end and intercalated with some of the modular members comprising one of said walls in spaced relationship above said grade, a second plurality of adjacent modular members also lying in said substantially common horizontal plane and connected at one end and intercalated with said some of the modular members comprising said one of said walls, and a third plurality of adjacent modular members lying in a second substantially common horizontal plane connected at one end and intercalated with some of the modular members comprising said one of said walls in spaced relationship above said grade, whereby said first and second pluralty of adjacent modular members present seating surfaces and said third plurality of modular members present a table located between said seating surfaces.

16. The structure of claim 1, wherein central axes of said plurality of holes in said others of said modular members are substantially perpendicular to said planar upper and lower surfaces.

17. The structure of claim 1, wherein central axes of said plurality of holes in said others of said modular members are spaced apart a substantially uniform distance.

18. The structure of claim 17, wherein said modular members present respective lengths between said spaced-apart ends, said length of each of said members being substantially equal to a whole number multiple of said distance between central axes of said spaced apart holes.

19. The structure of claim 18, wherein said door opening presents jambs and is substantially uniform in width, said door opening width defined as the horizontal distance between said ends of said modular members forming the jambs of said door opening, and wherein said width of said door opening is substantially a whole number multiple of said hole spacing.

20. The structure of claim 18, wherein said window opening presents jambs and is substantially uniform in width, said window opening width defined as the horizontal distance between said ends of said modular members forming the jambs of said window opening, and wherein said width of said window opening is substantially a whole number multiple of said hole spacing.

21. The structure of claim 1, wherein adjacent ones of at least some of said walls are perpendicular to one another.

22. The structure of claim 1, wherein said modular members present opposed sides and the width of said modular members is defined as the maximum distance between the sides.

23. The structure of claim 22, wherein said sides are arcuate in shape.

24. The structure of claim 1, wherein the holes of said ones and said others of said modular members present a first circular bore of a first diameter, a second, coaxial bore of a second diameter smaller than said first diameter, and a third circular bore coaxial with said first bore and having said first diameter, said second circular bore being located intermediate said first and third bores.

25. The structure of claim 24, wherein at least some of said connectors are tubular members presenting an axially aligned central opening, said tubular members being complementally sized for receipt within said first and said third bore but not said second bore.

26. The structure of claim 25, including an elongated retainer configured for insertion through said central opening of at least some of said tubular members and at least some of said second bores for retaining said ones and said others of said modular members in adjacency.

27. The structure of claim 26, wherein said elongated retainer includes a threaded rod configured for insertion through said central opening of at least some of said tubular members and at least some of said second bores and a washer and nut for coupling to said threaded rod sized for receipt within said first and third bores.

28. The structure of claim 1, wherein said window opening presents a top defined by a lintel modular member and a bottom defined by a sill modular member, and wherein the distance between said lintel modular member and said sill modular member is substantially a whole number multiple of said thickness of said modular members greater than two.

* * * * *